US006682168B2

(12) United States Patent
Nakagawa et al.

(10) Patent No.: US 6,682,168 B2
(45) Date of Patent: Jan. 27, 2004

(54) IMAGE PRINTING APPARATUS, CONTROL METHOD THEREFOR, STORAGE MEDIUM AND PROGRAM

(75) Inventors: Yoshinori Nakagawa, Kanagawa (JP); Jiro Moriyama, Kanagawa (JP); Hidehiko Kanda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/161,731

(22) Filed: Jun. 5, 2002

(65) Prior Publication Data

US 2002/0186273 A1 Dec. 12, 2002

(30) Foreign Application Priority Data

Jun. 7, 2001 (JP) ..... 2001-172742
May 20, 2002 (JP) ..... 2002-145208

(51) Int. Cl.[7] ..... B41J 2/145; B41J 2/15; B41J 29/38

(52) U.S. Cl. ..... 347/40; 347/16

(58) Field of Search ..... 347/16, 43, 40

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,608,577 A | | 8/1986 | Hori | 346/140 R |
| 4,723,129 A | | 2/1988 | Endo et al. | 346/1.1 |
| 4,740,796 A | | 4/1988 | Endo et al. | 346/1.1 |
| 5,121,142 A | * | 6/1992 | Iwazawa et al. | 347/41 |
| 5,485,183 A | * | 1/1996 | Zandian et al. | 347/41 |
| 6,371,608 B1 | | 4/2002 | Kato et al. | 347/96 |

FOREIGN PATENT DOCUMENTS

| | | |
|---|---|---|
| EP | 0 575 057 A2 | 12/1993 |
| EP | 1 045 333 A2 | 10/2000 |
| EP | 1 155 866 A2 | 11/2001 |
| GB | 2 251 581 A | 7/1992 |
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Thinh Nguyen
(74) *Attorney, Agent, or Firm*—Fitzpatrick, Cella, Harper & Scinto

(57) ABSTRACT

Printing of a unit pixel (1/D=1/600) in 4-pass printing (64 nozzles, and a total sheet supply amount of 62/600 in four operations) is exemplified in an image printing apparatus capable of printing a uniform, high-quality image while avoiding printing of a visually nonuniform image in multi-pass printing of two or more passes. With an image printing apparatus as described herein, satellites can be uniformly printed on the right and left of a unit pixel.

24 Claims, 16 Drawing Sheets

CONVENTIONAL 4-PASS PRINTING (1) SHEET SUPPLY AMOUNT= $\frac{1}{D}$ ×EVEN NUMBER (DISCHARGE INCLINATION DIRECTION OF Even NOZZLE→) (←DISCHARGE INCLINATION DIRECTION OF Odd NOZZLE)

(DISCHARGE INCLINATION DIRECTION OF Even NOZZLE→) (←DISCHARGE INCLINATION DIRECTION OF Odd NOZZLE)

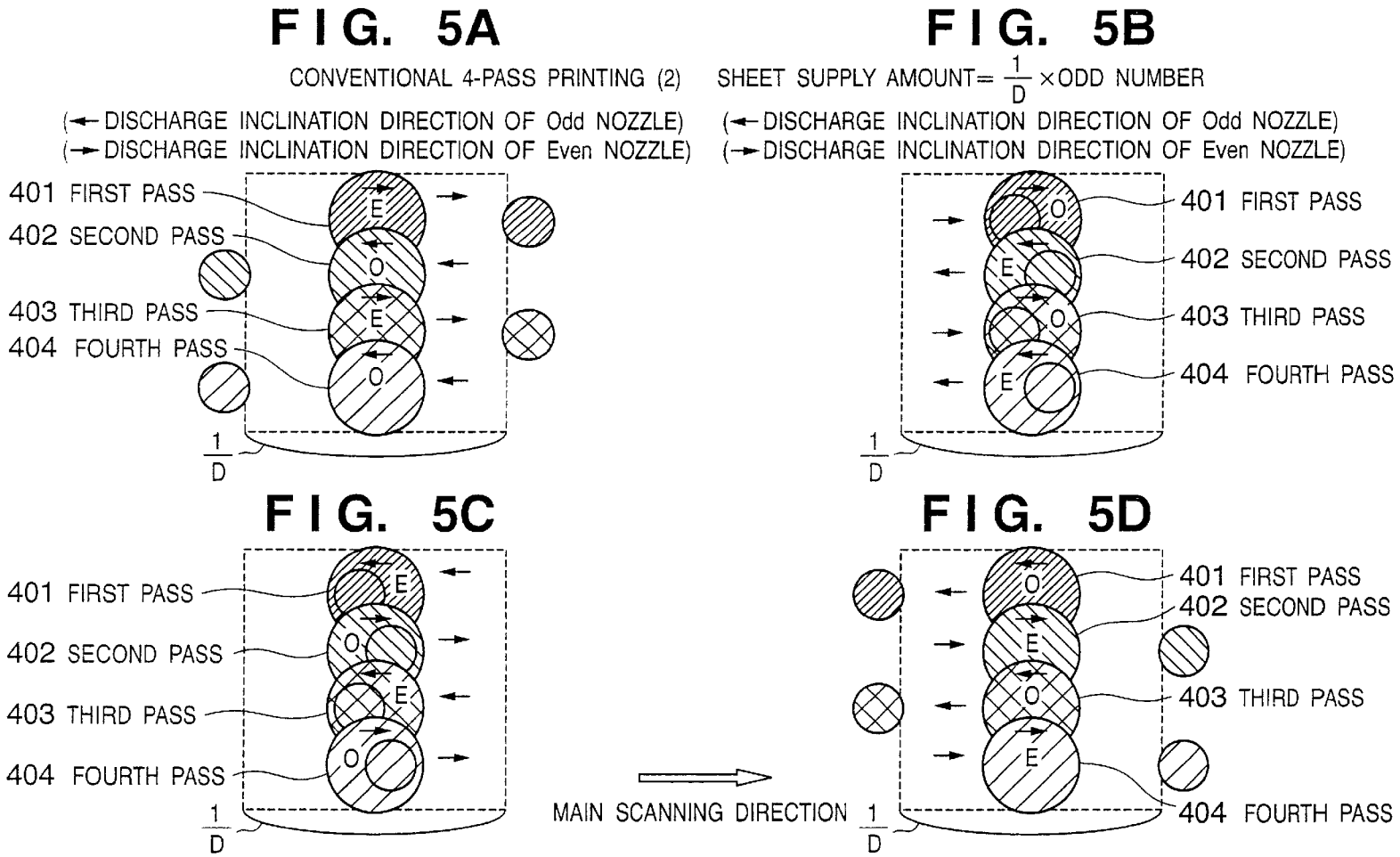
FIG. 5A
CONVENTIONAL 4-PASS PRINTING (2)
(↓ DISCHARGE INCLINATION DIRECTION OF Odd NOZZLE)
(↑ DISCHARGE INCLINATION DIRECTION OF Even NOZZLE)
401 FIRST PASS
402 SECOND PASS
403 THIRD PASS
404 FOURTH PASS
E
O
1/D
FIG. 5B
SHEET SUPPLY AMOUNT= 1/D ×ODD NUMBER
(↓ DISCHARGE INCLINATION DIRECTION OF Odd NOZZLE)
(↑ DISCHARGE INCLINATION DIRECTION OF Even NOZZLE)
401 FIRST PASS
402 SECOND PASS
403 THIRD PASS
404 FOURTH PASS
FIG. 5C
FIG. 5D
MAIN SCANNING DIRECTION

FIRST EMBODIMENT (4-PASS PRINTING)

(↓DISCHARGE INCLINATION DIRECTION OF Odd NOZZLE)
(↑DISCHARGE INCLINATION DIRECTION OF Even NOZZLE)

(↓DISCHARGE INCLINATION DIRECTION OF Odd NOZZLE)
(↑DISCHARGE INCLINATION DIRECTION OF Even NOZZLE)

SECOND EMBODIMENT (4-PASS PRINTING)

(↓ DISCHARGE INCLINATION DIRECTION OF Odd NOZZLE) (↓ DISCHARGE INCLINATION DIRECTION OF Odd NOZZLE)
(→ DISCHARGE INCLINATION DIRECTION OF Even NOZZLE) (→ DISCHARGE INCLINATION DIRECTION OF Even NOZZLE)

MAIN SCANNING DIRECTION

THIRD EMBODIMENT (4-PASS PRINTING)

(↓ DISCHARGE INCLINATION DIRECTION OF Odd NOZZLE) (↓ DISCHARGE INCLINATION DIRECTION OF Odd NOZZLE)
(↑ DISCHARGE INCLINATION DIRECTION OF Even NOZZLE) (↑ DISCHARGE INCLINATION DIRECTION OF Even NOZZLE)

IMAGE PRINTING APPARATUS, CONTROL METHOD THEREFOR, STORAGE MEDIUM AND PROGRAM

FIELD OF THE INVENTION

The present invention relates to an image printing apparatus, control method therefor, storage medium, and program and, more particularly, to a uniform image printing method in an ink-jet printing apparatus for printing information by discharging ink to a printing member.

BACKGROUND OF THE INVENTION

A printing apparatus used to print an image or the like in a printer, copying machine, facsimile apparatus, or the like, or a printing apparatus used as a print output device in a workstation or a composite electronic device including a computer, word processor, and the like prints an image or the like on a printing member (to be also referred to as a printing medium hereinafter) such as a sheet or plastic thin plate on the basis of image information (including all pieces of output information such as character information).

Printing apparatuses can be classified into an ink-jet type, wire dot type, thermal type, laser beam type, and the like depending on their printing methods.

Of these printing apparatuses, the ink-jet printing apparatus (to be referred to as an ink-jet printer hereinafter) prints information by discharging ink onto a printing medium from a printhead or the like. Compared to other printing types, the ink-jet printer has various advantages such as easy implementation of high resolution, high speed, low noise, and low cost.

In recent years, color outputs such as a color image become more and more important, and a variety of color ink-jet printers with high quality equivalent to a silver halide photograph have been developed.

To increase the printing speed, the ink-jet printer adopts a printhead on which pluralities of ink orifices and liquid channels are integrated as a printhead (to be also referred to as a multihead hereinafter) on which a plurality of printing elements are integrally aligned. To output color images, the ink-jet printer generally comprises a plurality of multiheads.

FIG. 1 is a view showing the main part of a general ink-jet printer for printing information on a sheet surface by using the multihead.

In FIG. 1, reference numerals 1101 denote ink-jet cartridges. These ink-jet cartridges are made up of ink tanks which store four color inks, i.e., black, cyan, magenta, and yellow inks, and multiheads 1102 corresponding to the respective inks.

FIG. 2 is a schematic view showing orifices (to be also referred to as nozzles hereinafter) for one color arranged in the multihead 1102 when viewed from a Z direction in FIG. 1.

In FIG. 2, reference numerals 1201 denote D nozzles aligned at a density of D nozzles per inch (D dpi) in the multihead 1102. Even-numbered nozzles out of d aligned nozzles will be called Even nozzles, and odd-numbered nozzles will be called Odd nozzles.

In FIG. 1, reference numeral 1103 denotes a sheet supply roller, which rotates together with an auxiliary roller 1104 in a direction indicated by an arrow in FIG. 1 while clamping a printing medium P between them, and conveys the printing medium P in the Y direction (subscanning direction, convey direction, and sheet supply direction).

Reference numerals 1105 denote a pair of sheet feed rollers, which feed a printing medium. Similar to the rollers 1103 and 1104, the pair of rollers 1105 rotate while clamping the printing medium P. The rotational speed of the rollers 1105 is set lower than that of the sheet supply roller 1103 to apply tension to the printing medium.

Reference numeral 1106 denotes a carriage which supports the four ink-jet cartridges 1101 and scans them at the same time as printing. The carriage 1106 stands by at a home position h represented by a broken line in FIG. 1 during an idle period of printing or in recovery processing of the multihead 1102.

If the carriage 1106 at the home position h receives a printing start instruction before the start of printing, the carriage 1106 moves in the X direction (main scanning direction). D/D-inch wide printing is done on a; sheet surface by the D nozzles 1201 of the multihead 1102 which are aligned at a density of D nozzles per inch. During an interval between the end of the first printing and the start of the second printing, the sheet supply roller 1103 rotates in the direction indicated by the arrow to supply the sheet in the Y direction by a D/D-inch width.

D/D-inch wide printing by the multiheads 1102 (information is printed on a 1-inch wide portion of a printing medium by using D nozzles) and sheet supply are repeated every main scanning of the carriage 1106, completing, e.g., printing of one page. This printing mode will be called a 1-pass printing mode.

Another printing mode will be described. If the carriage 1106 at the home position h receives a printing start instruction before the start of printing, the carriage 1106 moves in the X direction (e.g., forward direction of main scanning). D/D-inch wide printing is done on a sheet surface by the D nozzles 1201 of the multihead 1102 which are aligned at a density of D nozzles per inch.

Dots printed by this scanning form an image of specified image data which is interlaced into almost half by a predetermined pattern. During an interval between the end of the first printing and the start of the second printing, the sheet supply roller 1103 rotates in the direction indicated by the arrow to supply the sheet in the Y direction by a D/2D-inch width.

In the second scanning, the carriage 1106 is scanned in a direction (e.g., backward direction of main scanning) opposite to that in the first printing. Images are printed in accordance with respective patterns, completing printing in regions corresponding to respective nozzles. This printing mode will be called a 2-pass printing mode. M ($\geqq 2$)-pass printing will be generally called a multipass printing mode.

As a color printer, the ink-jet printer can optimally print a photographic image at high quality in the multipass printing mode.

However, a uniform image may not be obtained owing to the discharge direction of ink droplets discharged from nozzles, or ink droplets (to be referred to as satellites) which are separated from main droplets in discharge and are smaller than main droplets.

Especially when the discharge direction changes in the main scanning direction between Even and Odd nozzles of d aligned nozzles, the landing positions of satellites on the sheet surface change, failing to forming a uniform image.

A case in which a uniform image cannot be obtained due to satellites and different discharge directions of Even and Odd nozzles will be explained in detail with reference to the accompanying drawings.

FIGS. 3A to 3C are views showing the landing positions of a main droplet and satellite on a sheet surface serving as a printing medium in an ink droplet discharge direction.

FIG. 3A is a schematic view showing the landing positions of a main droplet and satellite when the ink droplet discharge direction is perpendicular to the sheet surface.

FIG. 3B is a schematic view showing the landing positions of a main droplet and satellite when the ink droplet discharge direction inclines to the carriage traveling direction.

FIG. 3C is a schematic view showing the landing positions of a main droplet and satellite when the ink droplet discharge direction inclines to a direction opposite to the carriage traveling direction.

In FIGS. 3A to 3C, reference numeral 1301 denotes a main droplet; 1302, a satellite; 1303, a carriage traveling direction; and 1304, a discharge inclination direction.

The landing positions of the main droplet and satellite when the ink droplet discharge direction is perpendicular to the sheet surface serving as a printing medium, i.e., the ink droplet discharge direction does not incline to the carriage traveling direction will be explained with reference to FIG. 3A.

In FIG. 3A, a comparison between the discharge speeds of the main droplet 1301 and satellite 1302 discharged from a nozzle reveals that the discharge speed of the main droplet 1301 is generally higher than that of the satellite 1302. A time taken to discharge ink and land it on the printing medium is longer for the satellite 1302 than for the main droplet 1301. The satellite 1302 lands on the sheet surface serving as a printing medium after the main droplet 1301 lands on it. A predetermined time is required for landing the satellite 1302 after the main droplet 1301 lands.

The main droplet 1301 and satellite 1302 are discharged while the carriage 1106 moves. The carriage speed in the carriage traveling direction is added to the discharge speeds of the main droplet 1301 and satellite 1302.

For this reason, the landing points of the main droplet 1301 and satellite 1302 on the sheet surface serving as a printing medium differ from each other. The satellite 1302 lands in the traveling direction of the carriage 1106 with respect to the landing position of the main droplet 1301 shown in FIG. 3A.

The landing positions of the main droplet and satellite when the ink droplet discharge direction inclines to the carriage traveling direction 1303 with respect to the sheet surface serving as a printing medium will be described with reference to FIG. 3B.

In FIG. 3B, the ink droplet discharge direction inclines to the carriage traveling direction 1303. The speed of the satellite 1302 in the carriage traveling direction 1303 is higher than the speed when the ink droplet discharge direction is perpendicular to the sheet surface (FIG. 3A). The satellite 1302 lands at a position shown in FIG. 3B more apart from the main droplet 1301 than the landing point of the satellite 1302 shown in FIG. 3A.

The landing positions of the main droplet and satellite when the ink droplet discharge direction inclines to a direction opposite to the carriage traveling direction 1303 with respect to the sheet surface serving as a printing medium will be described with reference to FIG. 3C.

In FIG. 3C, the ink droplet discharge direction inclines to a direction opposite to the carriage traveling direction 1303. The speed of the satellite 1302 in the carriage traveling direction is lower than the speed when the ink droplet discharge direction is perpendicular to the sheet surface (FIG. 3A). The satellite 1302 lands at a position nearer the main droplet 1301 than the landing point of the satellite 1302 shown in FIG. 3A, or on a side opposite to the carriage traveling direction. FIG. 3C shows a case in which the satellite 1302 lands at almost the same position as that of the main droplet 1301.

The printing quality problem in the multipass printing mode executed in a conventional ink-jet printer will be described with reference to FIGS. 4A to 4D and 5A to 5D.

In FIGS. 4A to 4D and 5A to 5D, the ink droplet discharge direction of an Even nozzle inclines to the main scanning direction, and that of an Odd nozzle inclines to a direction opposite to the main scanning direction. The problem is the same regardless of whether the inclination directions are reversed.

Examples in FIGS. 4A to 4D will be explained.

FIGS. 4A to 4D are schematic views each showing a case in which a 1/D-inch region is defined as a unit printing pixel (area surrounded by dotted line) in the multipass printing mode for performing 4-pass printing, four dots are printed in the unit printing pixel, and a printing medium is supplied by an even multiple of 1/D inch. In this case, the following four patterns are conceivable.

FIG. 4A is a schematic view showing a dot pattern when the first pass printing starts by an Even nozzle while the carriage travels in the main scanning (X) direction.

FIG. 4B is a schematic view showing a dot pattern when the first pass printing starts by an Odd nozzle while the carriage travels in the main scanning (X) direction.

FIG. 4C is a schematic view showing a dot pattern when the first pass printing starts by an Even nozzle while the carriage travels in a direction opposite to the main scanning (X) direction.

FIG. 4D is a schematic view showing a dot pattern when the first pass printing starts by an Odd nozzle while the carriage travels in a direction opposite to the main scanning (X) direction.

In FIGS. 4A to 4D, reference numeral 401 denotes a first pass printing dot; 402, a second pass printing dot; 403, a third pass printing dot; and 404, a fourth pass printing dot. In practice, four, first to fourth pass printing dots overlap each other and are printed. In FIGS. 4A to 4D, one main droplet and one satellite are formed, which express the tonality of the unit printing pixel. The following description adopts the above expression for descriptive convenience.

The dot patterns in FIGS. 4A to 4D appear on a printing medium as follows. That is, the dot patterns in FIGS. 4A and 4B (or FIGS. 4C and 4D) alternately appear every 1/D inch in the sheet supply direction.

In FIGS. 4A to 4D, arrows (← and→) illustrated in the unit printing pixel represent carriage traveling directions in respective pass printing operations. E represents a dot printed by an Even nozzle, and O represents a dot printed by an Odd nozzle. The printing quality problem in the conventional multipass printing mode will be explained in detail with reference to FIGS. 4A to 4D.

The pattern in FIG. 4A will be first described.

In FIG. 4A, the first pass printing is done by an Even nozzle while the carriage moves in the main scanning (X) direction. A main droplet 301 and satellite 302 land at distant positions.

The second pass printing is performed after a sheet is supplied by an even multiple of 1/D inch. This printing is also done by an Even nozzle. Since printing is performed while a carriage 106 moves in a direction opposite to the X direction, the main droplet 301 and satellite 302 land at close positions. The third and fourth pass printing operations are executed similarly to the first and second pass printing operations, thereby printing dots with a dot pattern as shown in FIG. 4A.

As shown in FIG. 4A, all the dots are printed by Even nozzles within the unit printing pixel when the first pass printing starts by an Even nozzle while the carriage 106 travels in the main scanning direction The pattern in FIG. 4B will be described.

In FIG. 4B, the first pass printing is done by an Odd nozzle while the carriage moves in a direction opposite to the main scanning direction (X). The main droplet 301 and satellite 302 land at distant positions.

The second pass printing is performed after a sheet is supplied by an even multiple of 1/D inch. This printing is also done by an Odd nozzle. Since printing is performed while the carriage 106 moves in the X direction, the main droplet 301 and satellite 302 land at close positions.

The third and fourth pass printing operations are executed similarly to the first and second pass printing operations, thus printing dots with a dot pattern as shown in FIG. 4B.

As shown in FIG. 4B, all the dots are printed by Odd nozzles within the unit printing pixel when the first pass printing starts by an Odd nozzle while the carriage 106 travels in the main scanning direction (X).

Similarly in FIG. 4C or 4D, all the dots within the unit printing pixel are printed by only Even or Odd nozzles.

If all the printing pixels are printed by Odd or Even nozzles, as shown in FIGS. 4A to 4D, the discharge characteristic may change such that the ink discharge amount differs between Odd and Even nozzles. The printing ink amount is large in a given pixel but small in another pixel. As a result, a visually nonuniform image is printed.

The patterns of FIG. 4A and FIG. 4B (or FIG. 4C and FIG. D) alternately appear every 1/D inch in the sheet supply direction. In other words, pixels (pixels as shown in FIG. 4A) in which satellites appear on the right of main droplets, and pixels (pixels as shown in FIG. 4B) in which satellites appear on the left of main droplets alternately appear every 1/D inch in the sheet supply direction. In other words, the satellite 302 alternately lands on the right and left of the main droplet 301 every 1/D inch. This leads to a visually nonuniform image.

Examples in FIGS. 5A to 5D will be explained.

FIGS. 5A to 5D are schematic views each showing a case in which a 1/D-inch region is defined as a unit printing pixel(area surrounded by dotted line) in the multipass printing mode for performing 4-pass printing, four dots are printed in the unit printing pixel, and a printing medium is supplied by an odd multiple of 1/D inch. In this case, the following four patterns are conceivable.

Similar to FIGS. 4A to 4D, FIGS. 5A to 5D show four dots as if they landed at different positions within a unit printing pixel for descriptive convenience. In practice, the four dots land at almost the same point within the unit printing pixel. The appearance of the dot patterns in FIGS. 5A to 5D is the same as that in FIGS. 4A to 4D. The dot patterns in FIGS. 5A and 5B (or FIGS. 5C and 5D) alternately appear every 1/D inch in the sheet supply direction.

FIG. 5A is a schematic view showing a dot pattern when the first pass printing starts by an Even nozzle while the carriage travels in the X direction.

FIG. 5B is a schematic view showing a dot pattern when the first pass printing starts by an Odd nozzle while the carriage travels in the X direction.

FIG. 5C is a schematic view showing a dot pattern when the first pass printing starts by an Even nozzle while the carriage travels in a direction opposite to the X direction.

FIG. 5D is a schematic view showing a dot pattern when the first pass printing starts by an Odd nozzle while the carriage travels in a direction opposite to the X direction.

In FIGS. 5A to 5D, reference numeral 401 denotes a first pass printing dot; 402, a second pass printing dot; 403, a third pass printing dot; and 404, a fourth pass printing dot. Arrows (← and→) illustrated in the unit printing pixel represent carriage traveling directions in respective pass printing operations. E represents a dot printed by an Even nozzle, and O represents a dot printed by an Odd nozzle. The reference numerals denote the same parts as in FIGS. 4A to 4D, and a repetitive description thereof will be omitted. The discharge inclinaptions of Odd and Even nozzles are also the same as those in FIGS. 4A to 4D.

The printing quality problem in the conventional multipass printing mode will be explained in detail with reference to FIGS. 5A to 5D.

The pattern in FIG. 5A will be first described.

In FIG. 5A, the first pass printing is done by an Even nozzle while the carriage moves in the main scanning (X) direction. The main droplet 301 and satellite 302 land at distant positions.

The second pass printing is performed after a sheet is supplied by an odd multiple of 1/D inch. This printing is done by an Odd nozzle. Since printing is performed while the carriage moves in a direction opposite while the X direction, the main droplet 301 and satellite 302 land at distant positions.

The third and fourth pass printing operations are executed similarly to the first and second pass printing operations, thereby printing dots with a dot pattern as shown in FIG. 5A.

As shown in FIG. 5A, all the dots are alternately printed using Odd and Even nozzles within the unit printing pixel when the first pass printing starts by an Even nozzle while the carriage 106 travels in the main scanning direction (X).

The pattern in FIG. 5B will be described.

In FIG. 5B, the first pass printing is done by an Odd nozzle while the carriage moves in the main scanning direction (X). The main droplet 301 and satellite 302 land at close positions.

The second pass printing is performed after a sheet is supplied by an odd multiple of 1/D inch. This printing is done by an Even nozzle. Since printing is performed while the carriage 106 moves in a direction opposite to the X direction, the main droplet 301 and satellite 302 land at close positions.

The third and fourth pass printing operations are executed similarly to the first and second pass printing operations, thus printing dots with a dot pattern as shown in FIG. 5B.

As shown in FIG. 5B, all the dots are alternately printed by Odd and Even nozzles within the unit printing pixel when the first pass printing starts by an Odd nozzle while the carriage 106 travels in the main scanning direction (X).

Although a description of the patterns in FIGS. 5C and SD will be omitted, all the dots within the unit printing pixel are alternately printed by Odd and Even nozzles, similar to FIGS. 5A and 5B.

That is, printing is achieved by supplying a sheet by an odd multiple of 1/D inch, as shown in FIGS. 5A to 5D. This prevents printing of all the unit printing pixels by only Odd or Even nozzles.

However, the patterns of FIG. 5A and FIG. 5B (or FIG. 5C and FIG.5D) alternately appear every 1/D inch in the sheet supply direction. The satellite 302 alternately lands on the right and left of the main droplet 301 every 1/D inch. In other words, pixels (pixels as shown in FIG. 5A) in which satellites appear on the right and left of main droplets, and pixels (pixels as shown in FIG. 5B) in which no satellite appears alternately appear every 1/D inch in the sheet supply direction. A visually nonuniform image is undesirably printed.

As described above, when a conventional ink-jet printer for repetitively scanning a printhead in the main scanning direction and a printing medium in the subscanning direction and forming an image by multipass (two or more passes) printing uses a multihead with a nozzle interval of 1/D inch and has different discharge characteristics between Odd and Even nozzles, this printer prints a visually nonuniform image by repetitively supplying a sheet by an even or odd multiple of 1/D inch.

SUMMARY OF THE INVENTION

The present Invention has been made to overcome the conventional drawbacks, and has as its object to provide an image printing apparatus capable of printing a uniform, high-quality image while avoiding printing of a visually nonuniform image in multipass printing of two or more passes, a control method therefor, storage medium and program.

To achieve the above object, an image forming apparatus according to an aspect of the present invention has the following arrangement. That is, an image printing apparatus which prints an image by multipass printing in which a printhead having a plurality of nozzles that are aligned at a predetermined nozzle pitch and discharge ink droplets is scanned on a printing medium in a direction cross to an alignment direction of the nozzles, and the printhead is scanned a plurality of number of times while ink droplets are discharged from different nozzles, thereby printing a predetermined printing region, comprising: convey means for conveying the printing medium in a convey direction by a predetermined convey amount every scanning; and control means for controlling the convey amount of the every scanning to a convey amount corresponding to either one of even and odd multiples of the nozzle pitch, and setting a convey amount corresponding to each of the even and odd multiples of the nozzle pitch at least once in the plurality of scanning operations. To achieve the above object, a control method for an image printing apparatus according to another aspect of the present invention has the following steps. That is, a control method for an image printing apparatus which prints an image by multipass printing in which a printhead having a plurality of nozzles that are aligned at a predetermined nozzle pitch and discharge ink droplets is scanned on a printing medium in a direction cross to an alignment direction of the nozzles, and the printhead is scanned a plurality of number of times while ink droplets are discharged from different nozzles, thereby printing a predetermined printing region, comprising: the convey step of conveying the printing medium in a convey direction by a predetermined convey amount every scanning; and the control step of controlling the convey amount of the every scanning to a convey amount corresponding to either one of even and odd multiples of the nozzle pitch, and setting a convey amount corresponding to each of the even and odd multiples of the nozzle pitch at least once in the plurality of scanning operations.

To achieve the above object, a computer-readable storage medium according to another aspect of the present invention has the following codes. That is, a computer-readable storage medium which stores a control program for an image printing apparatus which prints an image by multipass printing in which a printhead having a plurality of nozzles that are aligned at a predetermined nozzle pitch and discharge ink droplets is scanned on a printing medium in a direction cross to an alignment direction of the nozzles, and the printhead is scanned a plurality of number of times while ink droplets are discharged from different nozzles, thereby printing a predetermined printing region, the control program comprising: a program code of the convey step of conveying the printing medium in a convey direction by a predetermined convey amount every scanning; and a program code of the control step of controlling the convey amount of the every scanning to a convey amount corresponding to either one of even and odd multiples of the nozzle pitch, and setting a convey amount corresponding to each of the even and odd multiples of the nozzle pitch at least once in the plurality of scanning operations.

To achieve the above object, a control program according to still another aspect of the present invention has the following codes. That is, a control program for an image printing apparatus which prints an image by multipass printing in which a printhead having a plurality of nozzles that are aligned at a predetermined nozzle pitch and discharge ink droplets is scanned on a printing medium in a direction cross to an alignment direction of the nozzles, and the printhead is scanned a plurality of number of times while ink droplets are discharged from different nozzles, thereby printing a predetermined printing region, comprising: a program code of the convey step of conveying the printing medium in a convey direction by a predetermined convey amount every scanning; and a program code of the control step of controlling the convey amount of the every scanning to a convey amount corresponding to either one of even and odd multiples of the nozzle pitch, and setting a convey amount corresponding to each of the even and odd multiples of the nozzle pitch at least once in the plurality of scanning operations.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 5A to 5D are schematic views showing four dot patterns formed when the printing medium convey amount is an odd multiple of 1/D inch in conventional 4-pass printing, the ink droplet discharge direction of the Even nozzle inclines to the main scanning direction, and that of the Odd nozzle inclines to a direction opposite to the main scanning direction;

DETAILED DESCRIPTION OF THE PREFERRED EMBODIMENTS

Preferred embodiments of the present invention will now be described in detail in accordance with the accompanying drawings.

The embodiments will exemplify a serial ink-jet printer as an image printing apparatus, but do not limit the spirit and scope of the invention.

First Embodiment

[Control Arrangement]

Figure 1:
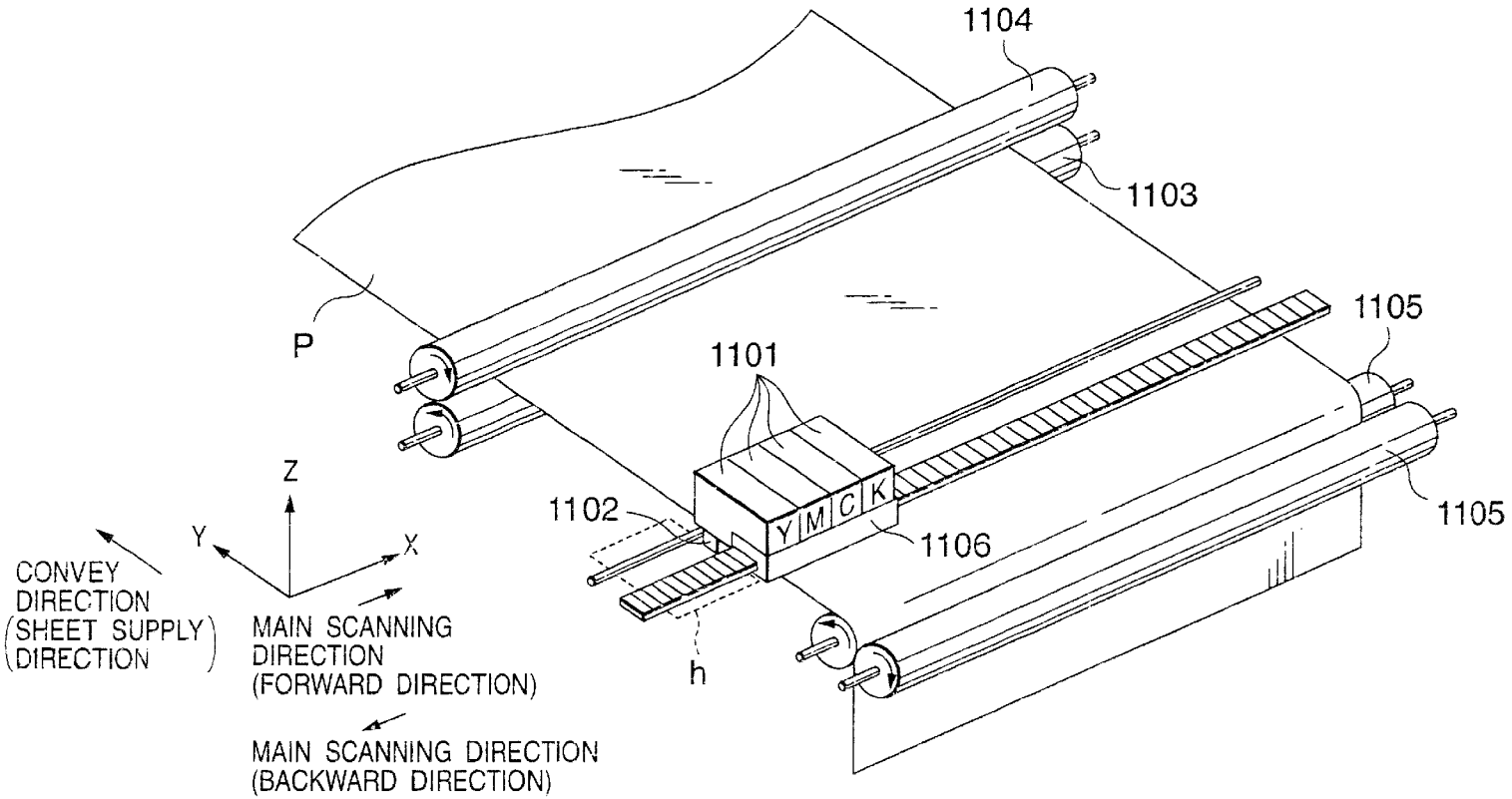
FIG. 1 is a view for explaining the main part of an ink-jet printer using a multihead.
Figure 2:
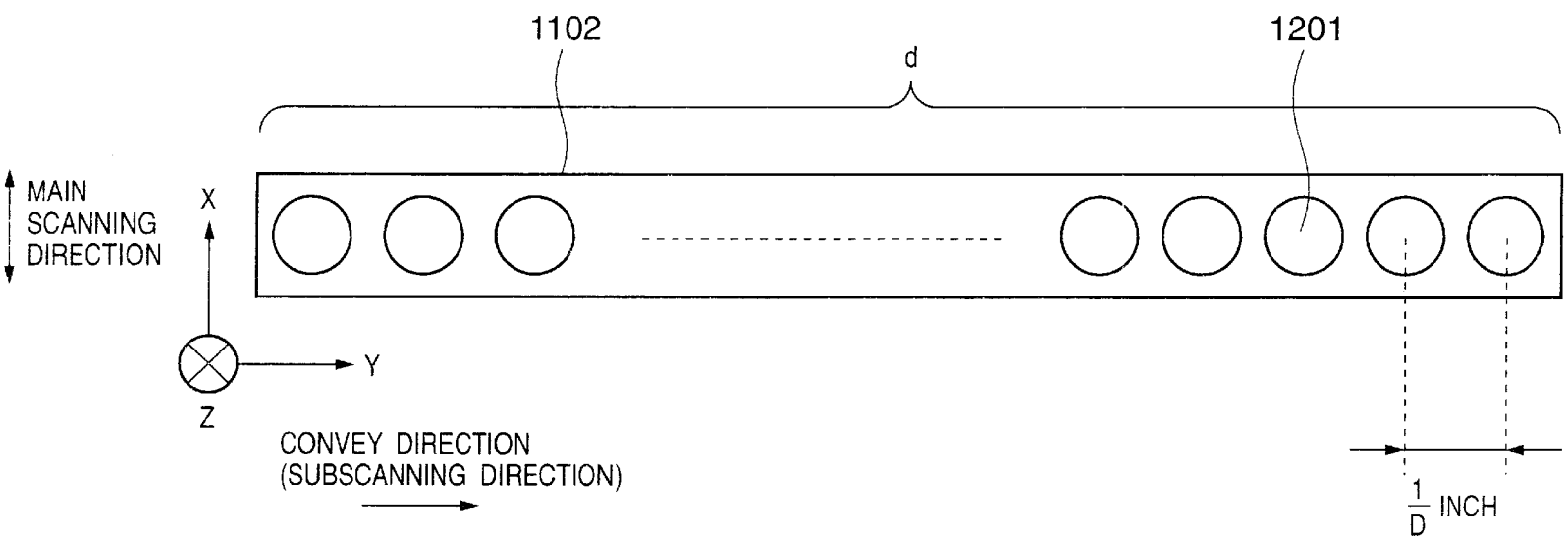
FIG. 2 is a schematic view for explaining orifices aligned in the multihead.
Figure 3A:
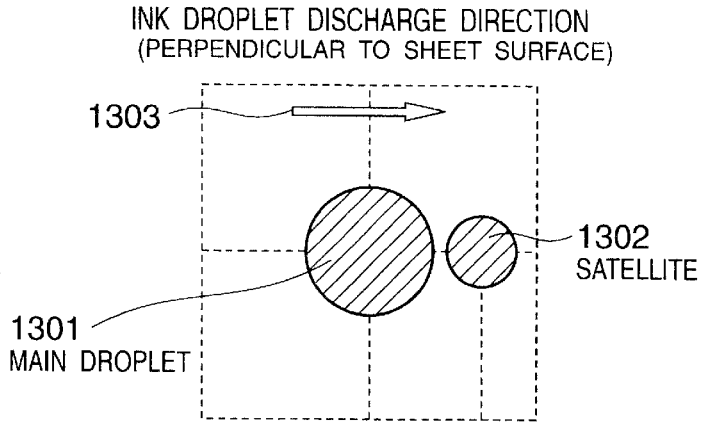
FIG. 3A is a schematic view for explaining the landing positions of a main droplet and satellite when the ink droplet discharge direction is perpendicular to the sheet surface.
Figure 3B:
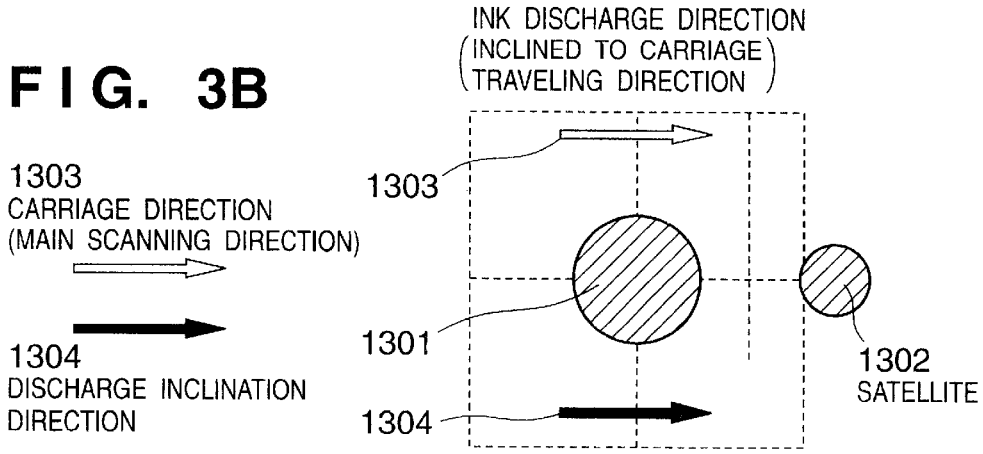
FIG. 3B is a schematic view for explaining the landing positions of the main droplet and satellite when the ink droplet discharge direction inclines to a carriage traveling direction.
Figure 3C:
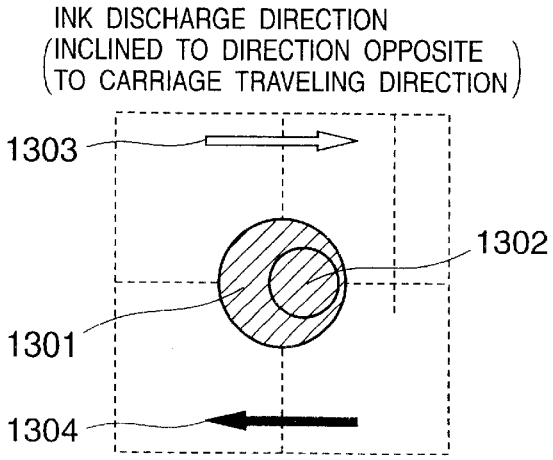
FIG. 3C is a schematic view for explaining the landing positions of the main droplet and satellite when the ink droplet discharge direction inclines to a direction opposite to the carriage traveling direction.
Figure 4A:
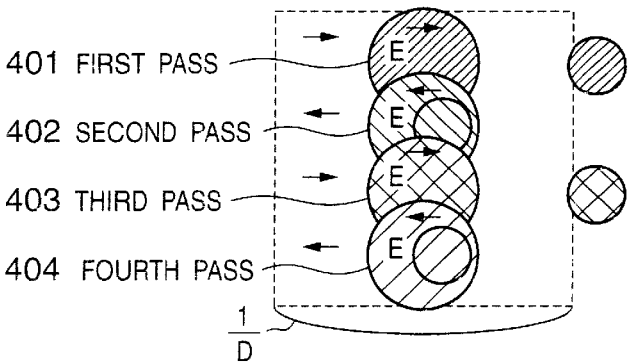
FIGS. 4A to 4D are schematic views showing four dot patterns formed when the printing medium convey amount is an even multiple of 1/D inch in conventional 4-pass printing, the ink droplet discharge direction of an Even nozzle inclines to the main scanning direction, and that of an Odd nozzle inclines to a direction opposite to the main scanning direction.
Figure 4B:
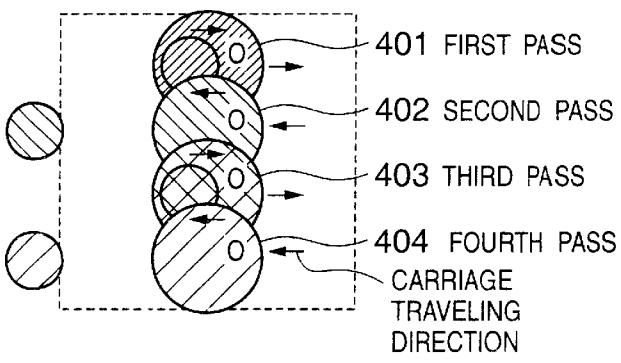
Figure 4C:
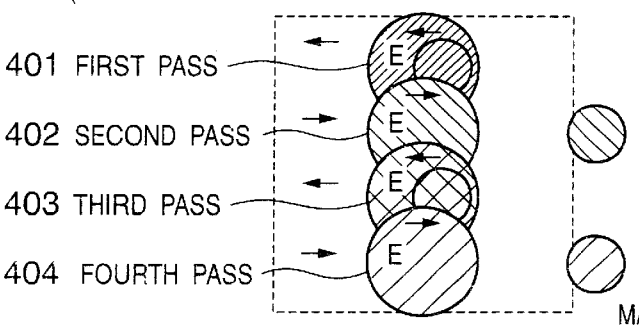
Figure 4D:
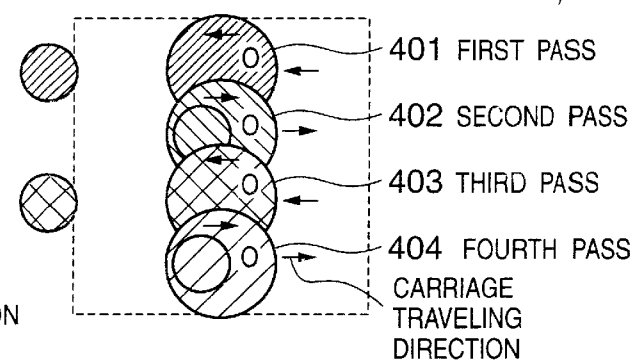
Figure 6:
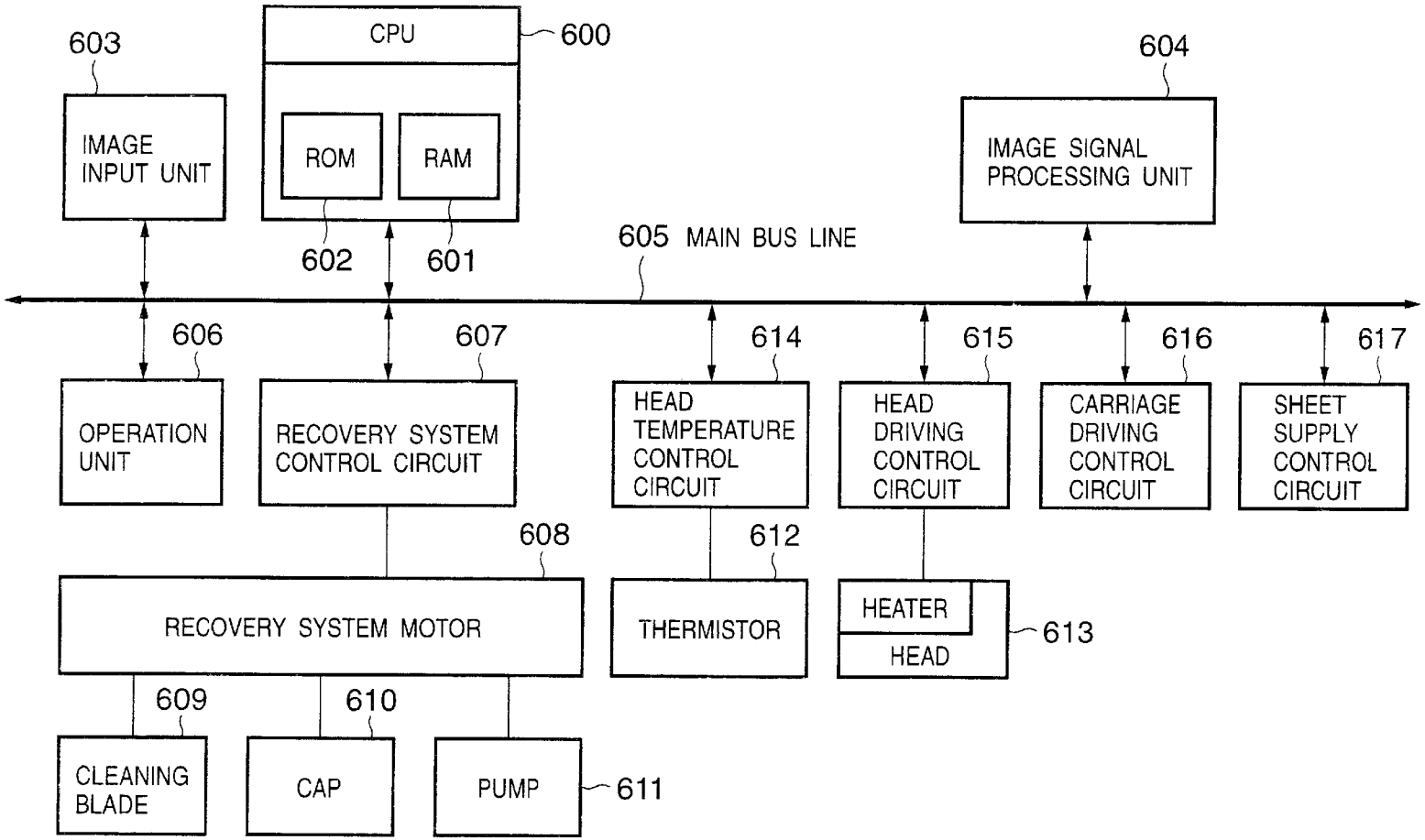
FIG. 6 is a block diagram showing the control arrangement of an ink-jet printer according to an embodiment of the present invention.

FIG. 6 is a block diagram showing the control arrangement of an ink-jet printer according to the first embodiment of the present invention. The mechanical arrangement of the ink-jet printer according to this embodiment is the same as a general one shown in FIG. 1, and a repetitive description thereof will be omitted.

In FIG. 6, a CPU 600 executes control of respective units (to be described below) and data processing via a main bus line 605. More specifically, the CPU 600 performs, via the respective units (to be described below), head driving control, carriage driving control, and data processing (to be described with reference to FIG. 7 and subsequent drawings) in accordance with a program stored in a ROM 601.

A RAM 602 is used as a work area for data processing and the like by the CPU 600. A hard disk or the like is arranged in addition to these memories.

An image input unit 603 has an interface with a host device (not shown), and temporarily holds an image input from the host device (not shown). An image signal processing unit 604 executes data processing in addition to color conversion, binarization, and the like.

An operation unit 606 has keys and the like, and allows the operator to input a control input and the like. A recovery system control circuit 607 controls recovery operation such as predischarge in accordance with a recovery processing program stored in the RAM 602. A recovery system motor 608 drives a printhead 613, and a cleaning blade 609, cap 610, and suction pump 611 which face the printhead 613 with an interval.

A head driving control circuit 615 controls driving of the ink discharge electrothermal transducer of the printhead 613, and generally causes the printhead 613 to perform predischarge or ink discharge for printing. A carriage driving control circuit 616 and sheet supply control circuit 617 respectively control movement of a carriage and supply of a sheet in accordance with programs.

A heater is mounted on a board which supports the ink discharge electrothermal transducer of the printhead 613. The heater can heat and adjust the ink temperature within the printhead to a desired setting temperature. A thermistor 612 is similarly mounted on the board and measures the actual ink temperature within the printhead. The thermistor 612 may be arranged outside the board or around the printhead.

[Printhead]

A printhead according to the embodiment of the present invention will be described with reference to the schematic view shown in FIG. 7.

Figure 7:
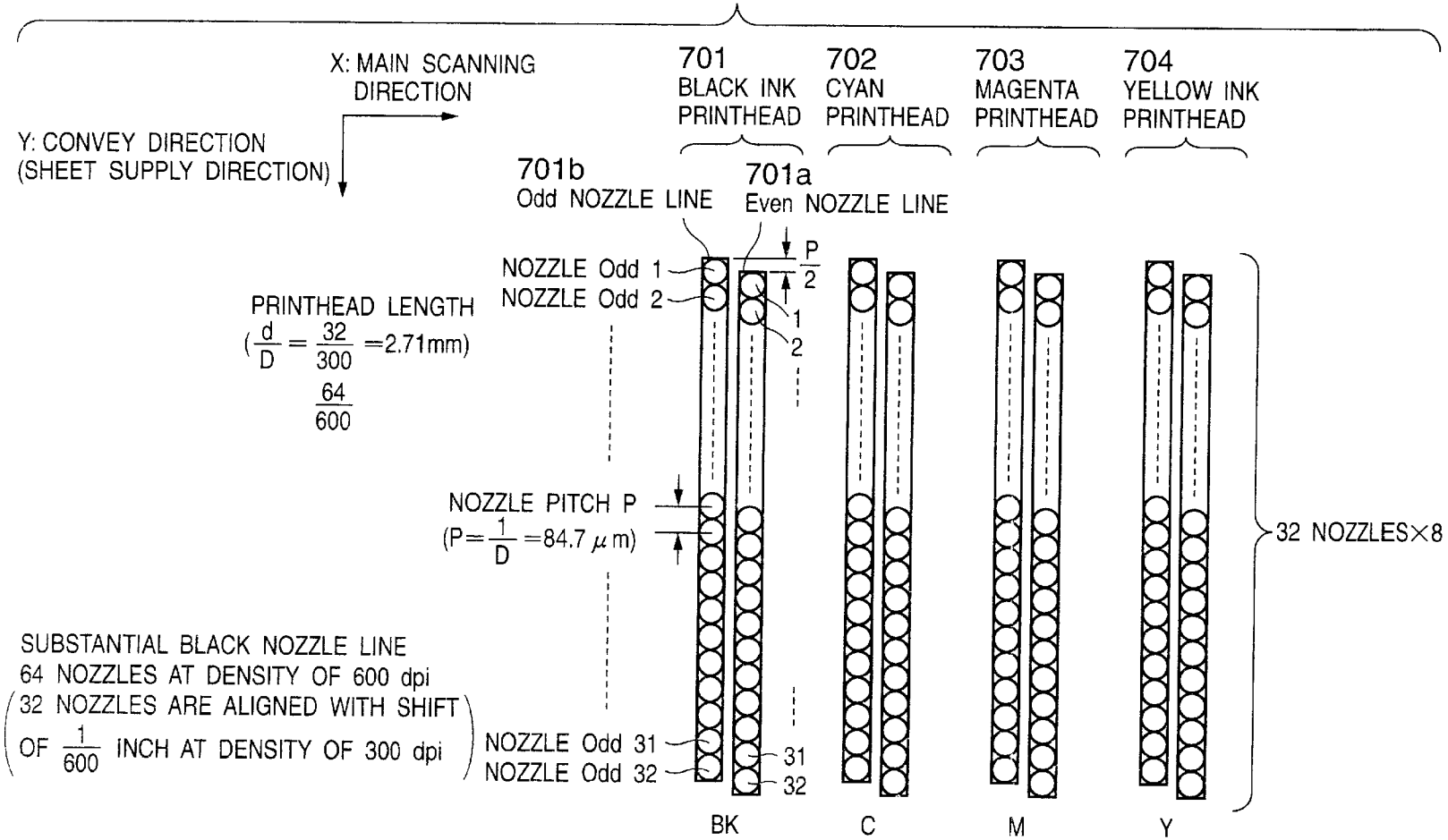
FIG. 7 is a schematic view showing a printhead according to the embodiment of the present invention.

In FIG. 7, reference numeral 701 denotes a black ink printhead; 702, a cyan ink printhead; 703, a magenta ink printhead; and 704, a yellow ink printhead. Each of the four color printheads is made up of an Even nozzle line 701*a* and Odd nozzle line 701*b*. These printheads are merely an example, and may take another arrangement.

Nozzles are aligned at a density of D=300 nozzles per inch (300 dpi) on the Even nozzle line 701*a* and Odd nozzle line 701*b* of black ink. An interval (nozzle pitch) P between nozzles is P=1/D=1/300 inches≈84.7 $\mu$m.

That is, each nozzle line has d=32 orifices (32 nozzles), and the printhead length (d/D) is d/D=32/300 inches≈2.71 mm. As shown in FIG. 7, the black ink Even nozzle line 701*a* and Odd nozzle line 701*b* shift from each other by P/2, i.e., 1/600 inch in the sheet supply direction (convey direction).

The black ink printhead, i.e., nozzle line 701 substantially has 64 nozzles aligned at a density of D=600 nozzles per inch (600 dpi).

The remaining three color ink printheads, i.e., cyan ink printhead 702, magenta ink printhead 703, and yellow ink printhead 704 have the same arrangement as that of the black ink printhead 701.

The black ink Odd nozzle line and the remaining three color nozzle lines are laid out parallel to each other in the main scanning (X) direction, as shown in FIG. 7.

The resolution of one pulse of a motor which drives a sheet supply roller for conveying a printing medium is 600 dots per inch (600 dpi) in covey amount conversion.

To perform a 1-pass printing mode by a black ink nozzle line of 64 nozzles at 600 dpi (about 2.71 mm), a printing medium is conveyed by a printing width of 2.71 mm in the convey direction (subscanning direction).

The above-described black ink nozzle line 701 is merely an example, and nozzles may be aligned at a density of D nozzles per inch (D dpi) and a nozzle pitch P (P=1/D). In this case, the resolution of one pulse of the motor which drives the sheet supply roller for conveying a printing medium is D dots per inch (D dpi) or a multiple of D dpi in covey amount conversion.

[Multipass Printing Mode]

A multipass printing mode using the ink-jet printer and printhead with the above-described control arrangement will be explained.

In the following description, a 4-pass printing mode in which a color nozzle line is divided into four by m=4 and an image is completed by four scanning operations will be exemplified as a multipass printing mode in which a color nozzle line is divided into m and an image is completed by m scanning operations. A description using the 4-pass printing mode is merely an example, and this embodiment can also be applied to a multipass printing mode of two or more passes.

Figure 8:
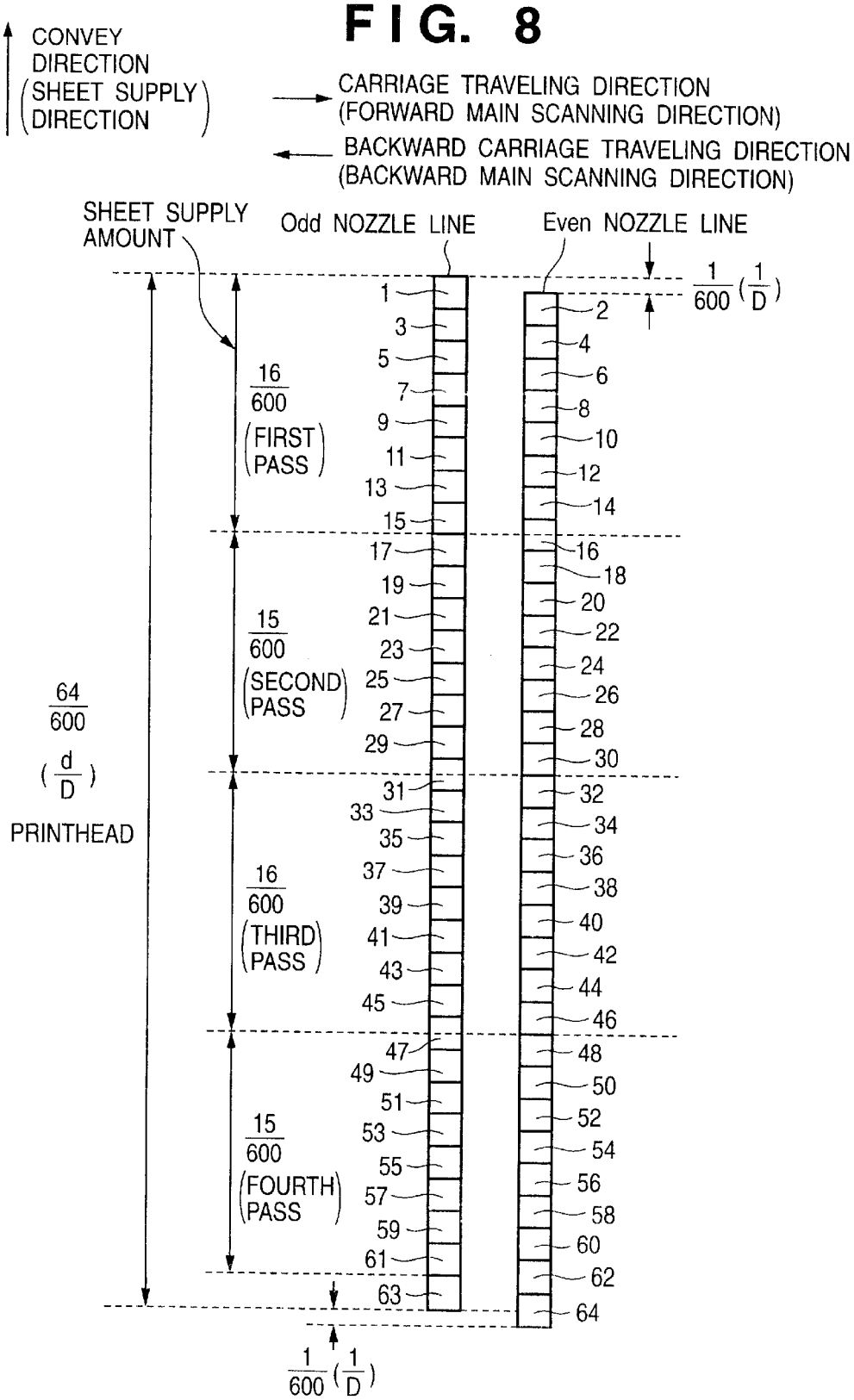
FIG. 8 is a schematic view for explaining the Even and Odd nozzles of the printhead and the sheet supply amount according to the first embodiment of the present invention.

According to the first embodiment, in the 4-pass printing mode using a color printhead shown in FIG. 8, the repetitive convey amount (sheet supply amount) in the printing medium convey direction is set to 16/600 inches for the first pass printing, 15/600 inches for the second pass printing, 16/600 inches for the third pass printing, and 15/600 inches for the fourth pass printing. These convey amounts are repeated such that a printing medium is repetitively conveyed in the printing medium convey direction by an even multiple of 1/600 inch (first pass printing), an odd multiple (second pass printing), an even multiple (third pass printing), and an odd multiple (fourth pass printing). This enables printing a uniform image without any influence of the satellite landing position.

In the color 4-pass printing mode of the first embodiment, a unit printing pixel is completed by a sheet supply amount of 62/600 dpi which is a total of four sheet supply amounts. An image is printed using only 62 nozzles 1 to 62 without using nozzles 63 and 64 shown in FIG. 8.

An image printing method according to the first embodiment in the color 4-pass printing mode will be explained with reference to FIGS. 9A to 9D, 10A, and 10B.

FIGS. 9A to 9D are schematic views each showing a dot pattern when a 1/600-inch region is defined as a unit printing pixel in the multipass printing mode for performing 4-pass printing, four dots are printed in the unit printing pixel, and a sheet is supplied repetitively by even and odd multiples of 1/600 inch.

Figure 9A:
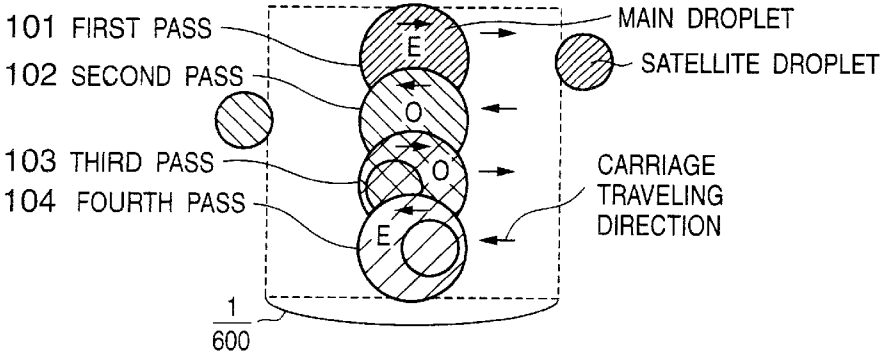
FIGS. 9A to 9D are schematic views showing four dot patterns formed when the ink droplet discharge direction of the Even nozzle inclines to the main scanning direction in 4-pass printing according to the first embodiment of the present invention, and that of the Odd nozzle inclines to a direction opposite to the main scanning direction.

FIG. 9A is a schematic view showing a dot pattern when the first pass printing starts by an Even nozzle while the carriage travels in the main scanning (X) direction.

Figure 9B:
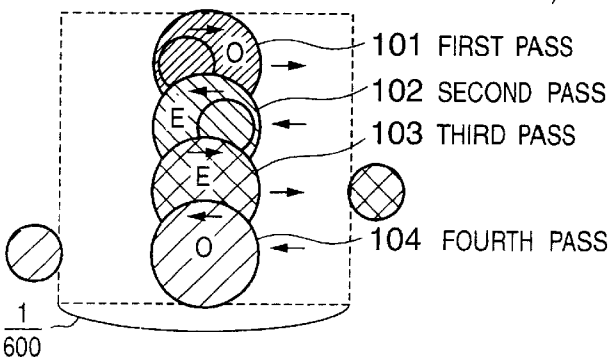

FIG. 9B is a schematic view showing a dot pattern when the first pass printing starts by an Odd nozzle while the carriage travels in the main scanning (X) direction.

Figure 9C:
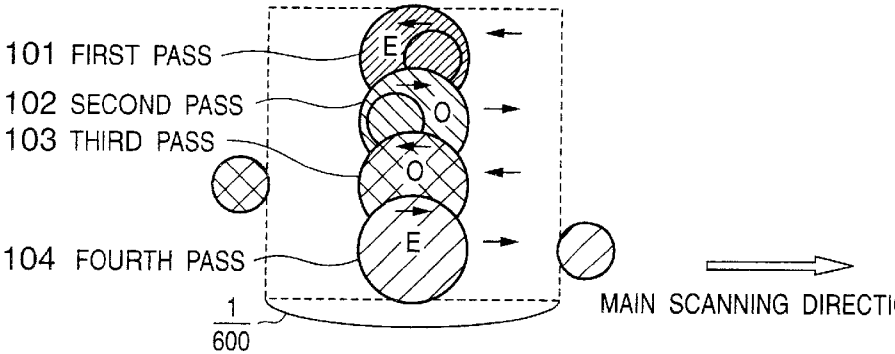

FIG. 9C is a schematic view showing a dot pattern when the first pass printing starts by an Even nozzle while the carriage travels in a direction opposite to the main scanning (X) direction.

Figure 9D:
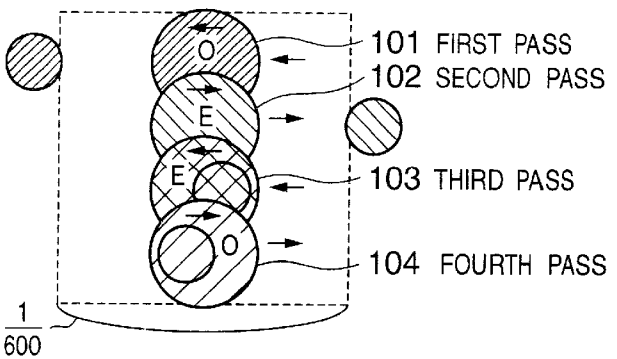

FIG. 9D is a schematic view showing a dot pattern when the first pass printing starts by an Odd nozzle while the carriage travels in a direction opposite to the main scanning (X) direction.

In FIGS. 9A to 9D, reference numeral 101 denotes a first pass printing dot; 102, a second pass printing dot; 103, a third pass printing dot; and 104, a fourth pass printing dot. In practice, four, first to fourth pass printing dots overlap each other and are printed. In FIGS. 9A to 9D, one main droplet and two satellites are formed, which express the tonality of the unit printing pixel. The following description adopts the above expression for descriptive convenience.

The dot patterns in FIGS. 9A to 9D appear on a printing medium as follows. That is, the dot patterns in FIGS. 9A and 9B (or FIGS. 9C and 9D) alternately appear every 1/D inch in the sheet supply direction.

In FIGS. 9A to 9D, arrows (← and→) illustrated in the unit printing pixel represent carriage traveling directions in respective pass printing operations. E represents a dot printed by an Even nozzle, and O represents a dot printed by an Odd nozzle. In FIGS. 9A to 9D, the ink droplet discharge direction inclines to the main scanning (X) direction for an Even nozzle and an opposite direction for an Odd nozzle.

Image printing in the multipass printing mode (four passes) will be described in detail with reference to FIGS. 9A to 9D, 10A, and 10B.

The pattern in FIG. 9A will be first described.

Figure 10A:
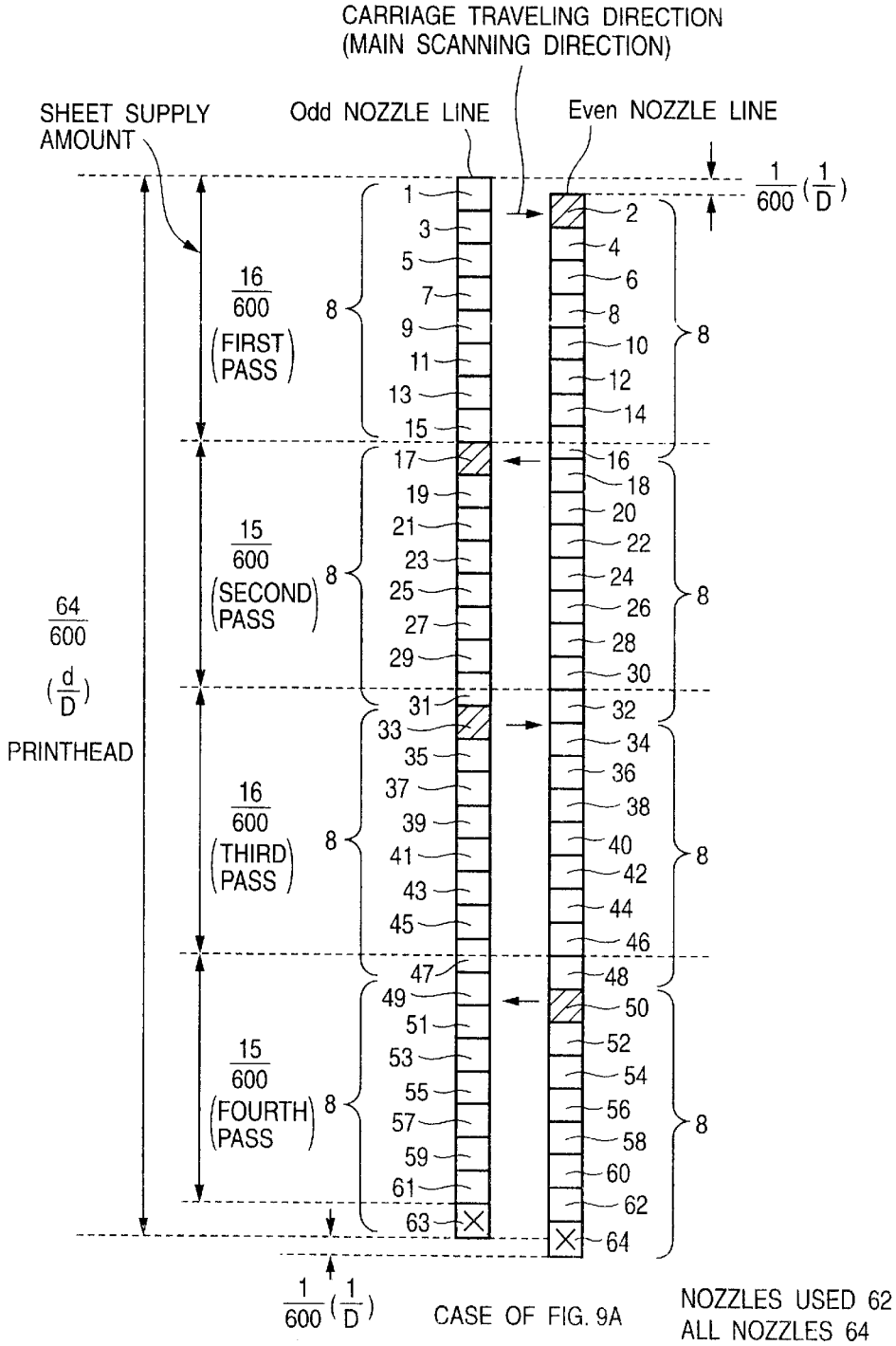
FIG. 10A is a schematic view for explaining a printing method using 4-pass printing (FIG. 9A) according to the first embodiment of the present invention.

In FIG. 9A, the first pass printing is done using an arbitrary Even nozzle while the carriage moves in the X direction. A main droplet and satellite land at distant positions. After the first pass printing ends, a sheet is supplied by 16/600 inches. In FIG. 10A, the first pass printing of a unit printing pixel is performed using, e.g., Even nozzle 2. After the first pass printing ends, the sheet is supplied by 16/600 inches.

The second pass printing is done using an arbitrary Odd nozzle while the carriage moves in a direction opposite to the main scanning (X) direction. A main droplet and satellite land at distant positions (distant positions in a direction opposite to those of the first pass printing). After the second pass printing ends, the sheet is supplied by 15/600 inches. In FIG. 10A, the second pass printing of the same unit printing pixel is performed using, e.g., Odd nozzle 17. After the second pass printing ends, the sheet is supplied by 15/600 inches.

The third pass printing is done using an arbitrary Odd nozzle while the carriage moves in the X direction. A main droplet and satellite land at close positions. After the third pass printing ends, the sheet is supplied by 16/600 inches. In FIG. 10A, the third pass printing of the same unit printing pixel is performed using, e.g., Odd nozzle 33. After the third pass printing ends, the sheet is supplied by 16/600 inches.

The fourth pass printing is done using an arbitrary Even nozzle while the carriage moves in a direction opposite to the main scanning (X) direction. A main droplet and satellite land at close positions. After the fourth pass printing ends, the sheet is supplied by 15/600 inches. In FIG. 10A, the fourth pass printing of the same unit printing pixel is performed using, e.g., Even nozzle 50. After the fourth pass printing ends, the sheet is supplied by 15/600 inches.

This 4-pass image printing uniformly prints satellites each on the right and left of a pixel printed by main droplets, as shown in FIG. 9A.

The pattern in FIG. 9B will be described.

Figure 10B:
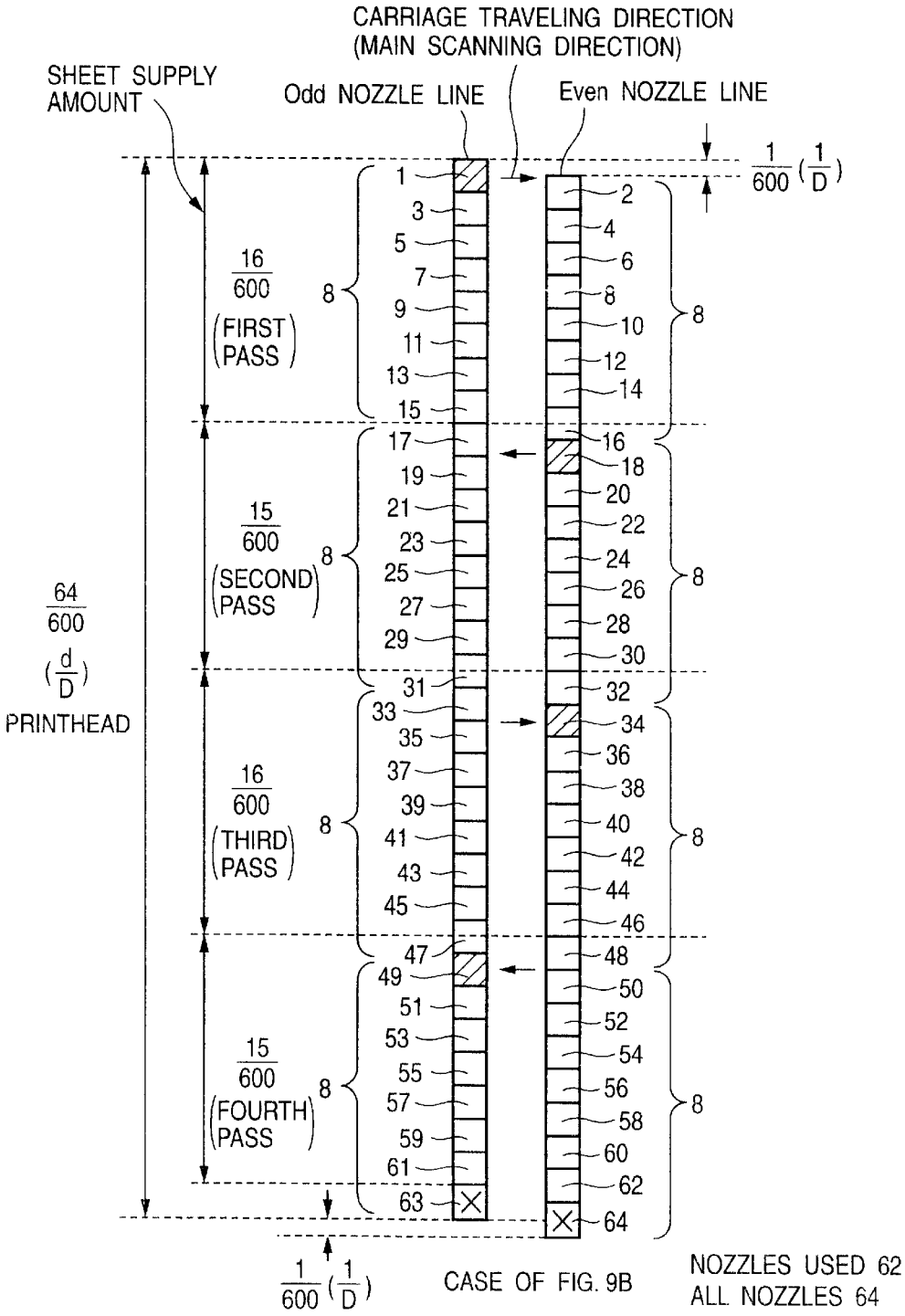
FIG. 10B is a schematic view for explaining a printing method using 4-pass printing (FIG. 9B) according to the first embodiment of the present invention.

In FIG. 9B, the first pass printing is done using an arbitrary Odd nozzle while the carriage moves in the X direction. A main droplet and satellite land at close positions. After the first pass printing ends, a sheet is supplied by 16/600 inches. In FIG. 10B, the first pass printing of a unit printing pixel is performed using, e.g., Odd nozzle 1. After the first pass printing ends, the sheet is supplied by 16/600 inches.

The second pass printing is done using an arbitrary Even nozzle while the carriage moves in a direction opposite to the main scanning (X) direction. A main droplet and satellite land at close positions. After the second pass printing ends, the sheet is supplied by 15/600 inches. In FIG. 10B, the second pass printing of the same unit printing pixel is performed using, e.g., Even nozzle 18. After the second pass printing ends, the sheet is supplied by 15/600 inches.

The third pass printing is done using an arbitrary Even nozzle while the carriage moves in the X direction. A main droplet and satellite land at distant positions. After the third pass printing ends, the sheet is supplied by 16/600 inches. In FIG. 10B, the third pass printing of the same unit printing pixel is performed using, e.g., Even nozzle 34. After the third pass printing ends, the sheet is supplied by 16/600 inches.

The fourth pass printing is done using an arbitrary Odd nozzle while the carriage moves in a direction opposite to the main scanning (X) direction. A main droplet and satellite land at distant positions (distant positions in a direction opposite to those of the third pass printing). After the fourth pass printing ends, the sheet is supplied by 15/600 inches. In FIG. 10B, the fourth pass printing of the same unit printing pixel is performed using, e.g., Odd nozzle 49. After the fourth pass printing ends, the sheet is supplied by 15/600 inches.

This 4-pass image printing uniformly prints satellites each on the right and left of a pixel printed by main droplets, as shown in FIG. 9B.

The patterns in FIGS. 9C and 9D are the same as those in FIGS. 9A and 9B except that carriage traveling directions in respective pass operations are opposite. As shown in FIG. 9C or 9D, satellites are uniformly printed on the right and left of a pixel printed by main droplets, and a detailed description thereof will be omitted.

Sheet conveyance at an odd multiple of the nozzle pitch and sheet conveyance at an even multiple thereof are sequentially repeated to print 600"-square unit printing pixels by 4-pass printing (4-dot printing). Pixels (pixels shown in FIGS. 9A to 9D) in each of which satellites discharged from Even and Odd nozzles appear each on the right and left of a main droplet can be printed. In any of FIGS. 9A to 9D, the same number of satellites appear on the right and left of a main droplet, resulting in a uniform image. According to the first embodiment, the dot patterns in FIGS. 9A and 9B (or FIGS. 9C and 9D) alternately appear every 1/D inch in the sheet supply direction. More specifically, pixels (pixels as shown in FIG. 9A) in each of which satellites each appear on the right and left of a main droplet, and pixels (pixels as shown in FIG. 9B) in each of which satellites each appear on the right and left of a main droplet alternately appear every 1/D inch in the sheet supply direction. Satellites uniformly appear in all the pixels, which solves the conventional problems in FIGS. 4A to 4D and 5A to 5D.

Note that 4-pass printing has been exemplified, but the above description can be applied to multipass printing of two or more passes. In the above description, the Even and Odd nozzles of each ink printhead are aligned on different nozzle lines. The printhead may take another array in which, e.g., Even and Odd nozzles are aligned on the same line.

If the nozzle line of the printhead is made up of nozzles aligned at a density of D nozzles per inch (D dpi) and a nozzle pitch P (P=1/D), the resolution of one pulse of the motor which drives the sheet supply roller for conveying a printing medium is D dots per inch (D dpi) or a multiple of D dpi in covey amount conversion.

As described above, the ink-jet printer of the first embodiment supplies a printing medium repetitively by even and odd multiples of 1/D (1/600 inch in the above description) in multipass printing of two or more passes (four passes in the above description). In this case, dots discharged from Even and Odd nozzles are uniformly printed in all the unit printing pixels, and satellites are uniformly printed (distributed) on the right and left of main droplets. Printing of a nonuniform image can be avoided, and high-quality image printing can be realized.

Second Embodiment

An ink-jet printer according to the second embodiment will be described.

The mechanical arrangement, control arrangement, and printhead of the ink-jet printer according to the second embodiment are the same as the mechanical arrangement (FIG. 1), control arrangement (FIG. 6), and printhead (FIGS. 7 and 8) of the ink-jet printer described in the first embodiment, and a repetitive description thereof will be omitted.

[Multipass Printing Mode]

A multipass printing mode using the ink-jet printer and printhead will be explained.

In the following description, a 4-pass printing mode in which a color nozzle line is divided into four by m=4 and an image is completed by four scanning operations will be exemplified as a multipass printing mode in which a color nozzle line is divided into m (m is 2 or more) and an image is completed by m scanning operations.

The feature of the second embodiment will be described.

In the first embodiment, the present invention is applied to a case in which four sheet supply amounts of a printing medium are alternately set to even and odd multiples of 1/D inch in a 4-pass printing mode. In the second embodiment, the present invention is applied to a case in which four sheet supply amounts of a printing medium are not alternately set to even and odd multiples of 1/D inch in the 4-pass printing mode.

Figure 11:
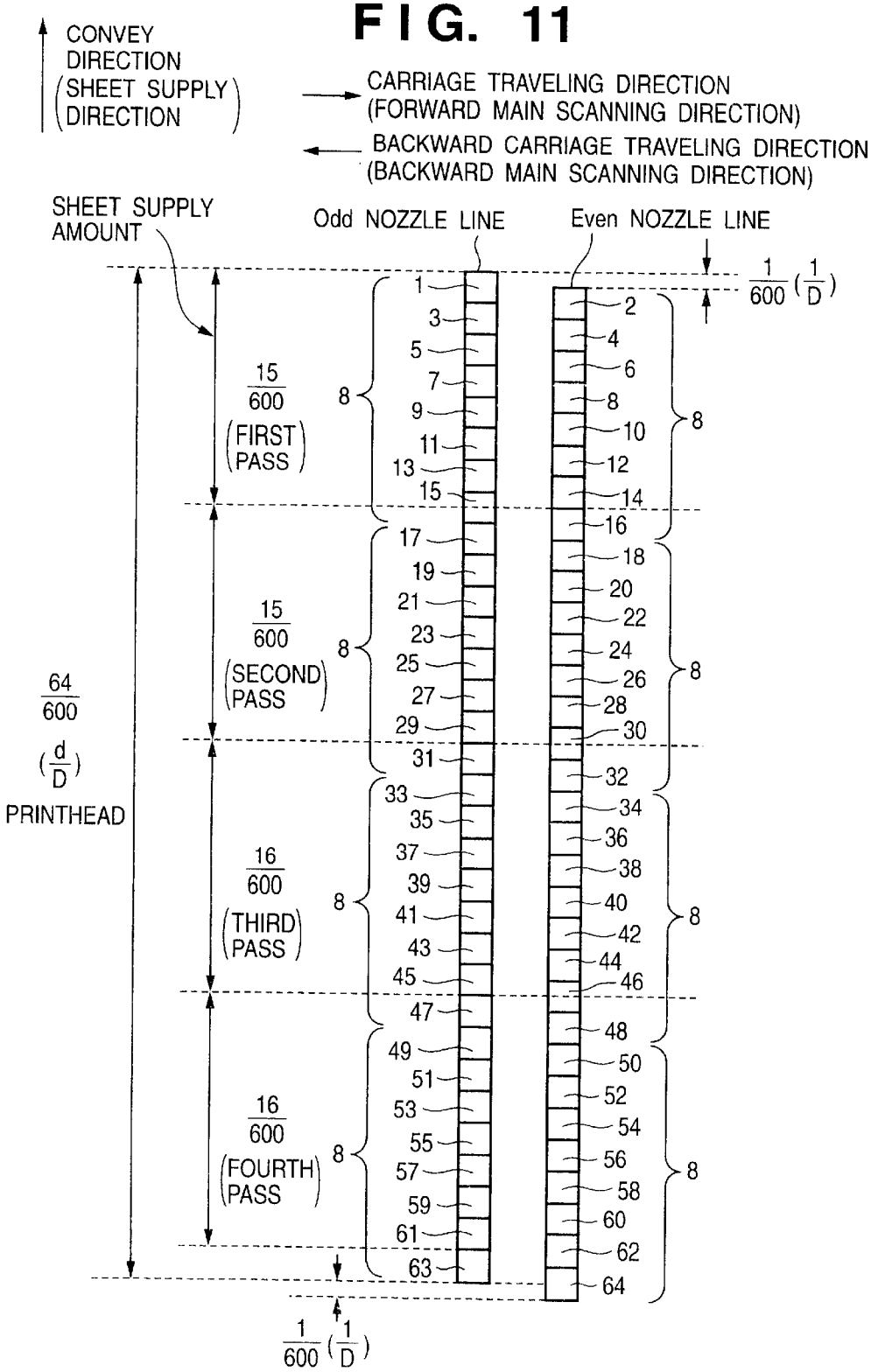
FIG. 11 is a schematic view for explaining the Even and Odd nozzles of the printhead and the sheet supply amount according to the second embodiment of the present invention.

More specifically, as shown in FIG. 11, the first convey amount is 15/600 inches; the second convey amount, 15/600 inches; the third convey amount, 16/600 inches; and the fourth convey amount, 16/600 inches.

According to the second embodiment, in the 4-pass printing mode using a color printhead shown in FIG. 11, the repetitive convey amount (sheet supply amount) in the printing medium convey direction is set to 15/600 inches for the first pass printing, 15/600 inches for the second pass printing, 16/600 inches for the third pass printing, and 16/600 inches for the fourth pass printing. These convey amounts are repeated such that a printing medium is repetitively conveyed in the printing medium convey direction by an odd multiple of 1/D=1/600 inch (first pass printing), an odd multiple (second pass printing), an even multiple (third pass printing), and an even multiple (fourth pass printing). Accordingly, a uniform image can be printed without any influence of the satellite landing position.

In the color 4-pass printing mode of the second embodiment, a unit printing pixel is completed by a sheet supply amount of 62/600 dpi which is a total of four sheet supply amounts. An image is printed using only 62 nozzles 1 to 62 without using nozzles 63 and 64 shown in FIG. 11.

An image printing method according to the second embodiment in the color 4-pass printing mode will be explained with reference to FIGS. 12A to 12D, 13A, and 13B.

FIGS. 12A to 12D are schematic views each showing a dot pattern when a 1/600-inch region is defined as a unit printing pixel in the multipass printing mode for performing 4-pass printing, four dots are printed in the unit printing pixel, and a sheet is supplied repetitively by even and odd multiples of 1/600 inch.

Figure 12A:
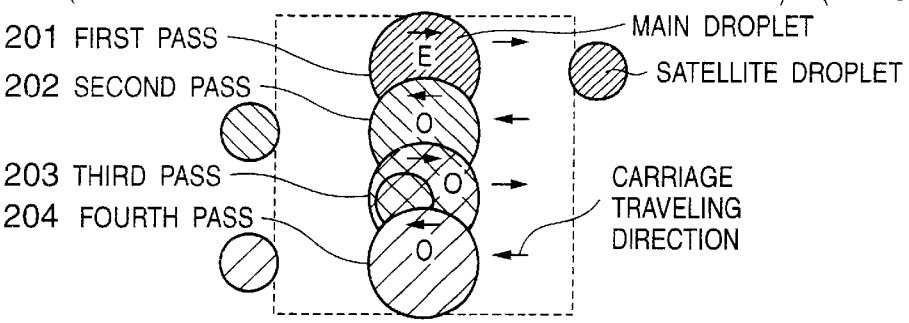
FIGS. 12A to 12D are schematic views showing four dot patterns formed when the ink droplet discharge direction of the Even nozzle inclines to the main scanning direction in 4-pass printing according to the second embodiment of the present invention, and that of the Odd nozzle inclines to a direction opposite to the main scanning direction.

FIG. 12A is a schematic view showing a dot pattern when the first pass printing starts by an Even nozzle while the carriage travels in the main scanning (X) direction.

Figure 12B:
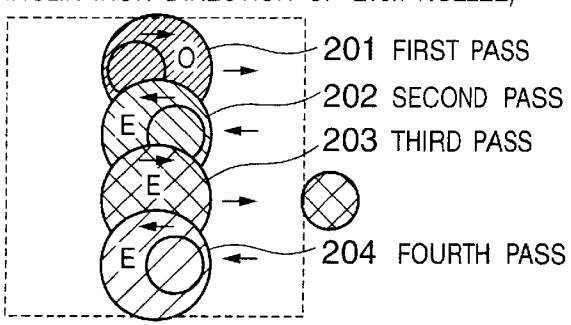

FIG. 12B is a schematic view showing a dot pattern when the first pass printing starts by an Odd nozzle while the carriage travels in the main scanning (X) direction.

Figure 12C:
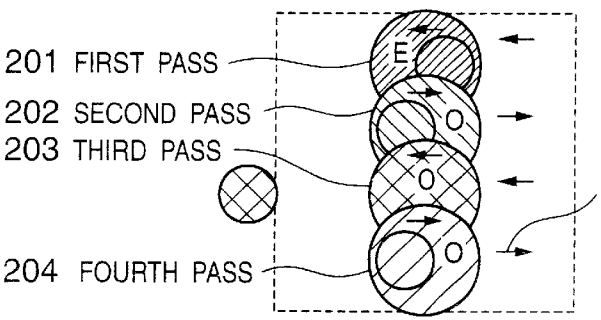

FIG. 12C is a schematic view showing a dot pattern when the first pass printing starts by an Even nozzle while the carriage travels in a direction opposite to the main scanning (X) direction.

Figure 12D:
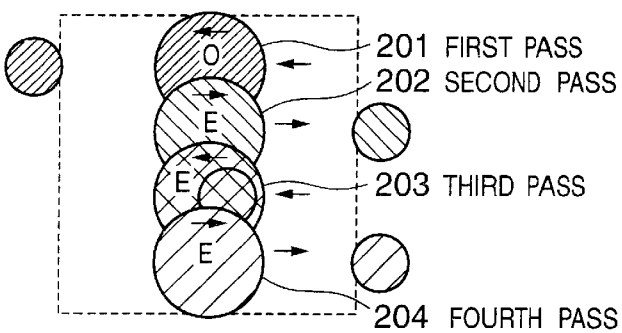

FIG. 12D is a schematic view showing a dot pattern when the first pass printing starts by an Odd nozzle while the carriage travels in a direction opposite to the main scanning (X) direction.

In FIGS. 12A to 12D, reference numeral 201 denotes a first pass printing dot; 202, a second pass printing dot; 203, a third pass printing dot; and 204, a fourth pass printing dot. In practice, four, first to fourth pass printing dots overlap each other and are printed. In FIGS. 12A to 12D, one main droplet and two satellites are formed, which express the tonality of the unit printing pixel. The following description adopts the above expression for descriptive convenience.

The dot patterns in FIGS. 12A to 12D appear on a printing medium as follows. That is, the dot patterns in FIGS. 12A and 12B (or FIGS. 12C and 12D) alternately appear every 1/D inch in the sheet supply direction.

In FIGS. 12A to 12D, arrows (← and→) illustrated in the unit printing pixel represent carriage traveling directions in respective pass printing operations. E represents a dot printed by an Even nozzle, and O represents a dot printed by an Odd nozzle.

The ink droplet discharge direction inclines to the main scanning (X) direction for an Even nozzle and an opposite direction for an Odd nozzle.

Image printing in the multipass printing mode (four passes) will be described in detail with reference to FIGS. 12A to 12D, 13A, and 13B.

The pattern in FIG. 12A will be described.

Figure 13A:
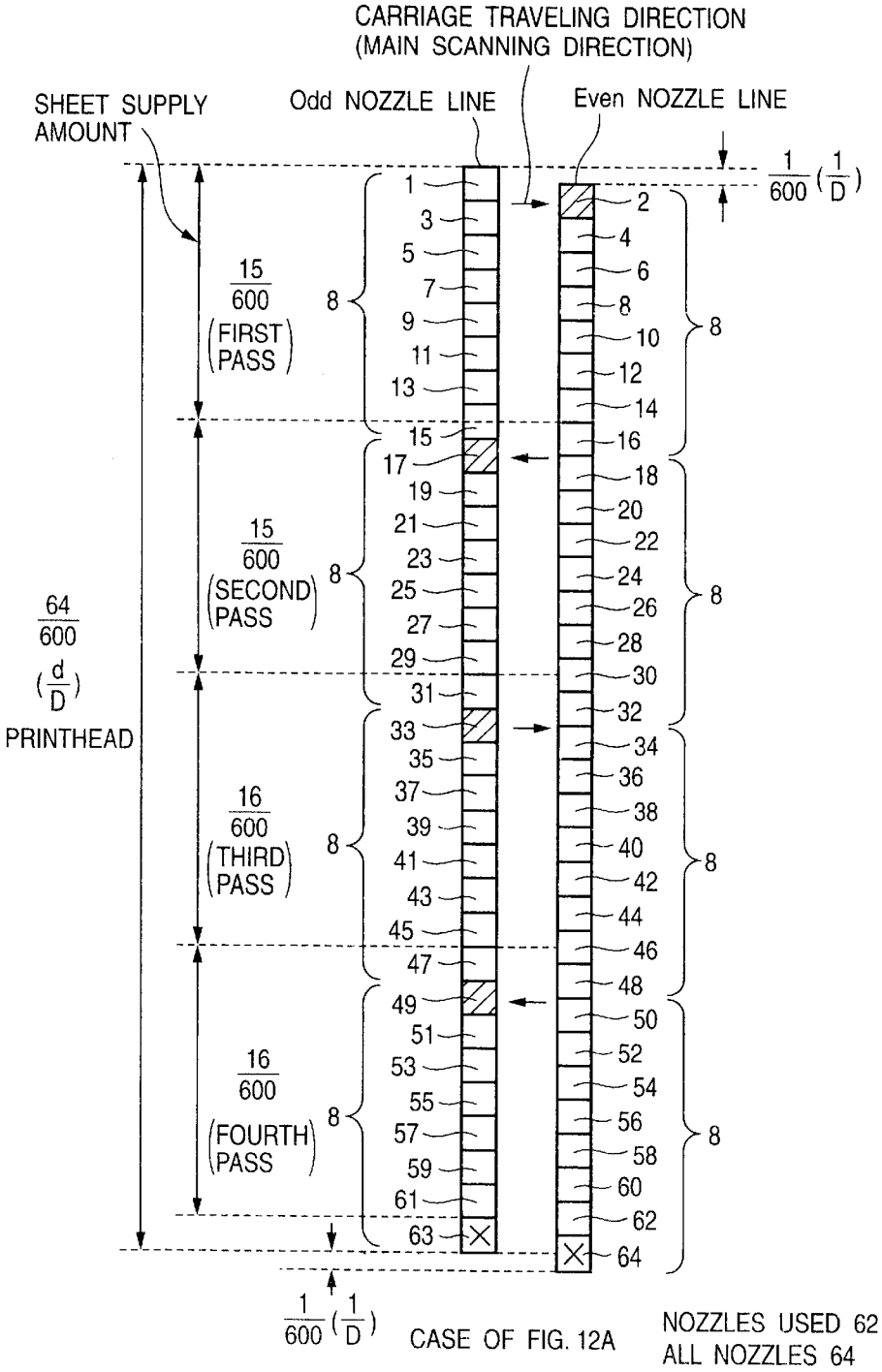
FIG. 13A is a schematic view for explaining a printing method using 4-pass printing according to the second embodiment of the present invention.

In FIG. 12A, the first pass printing is done using an arbitrary Even nozzle while the carriage moves in the X direction. A main droplet and satellite land at distant positions. After the first pass printing ends, a sheet is supplied by 15/600 inches. In FIG. 13A, the first pass printing of a unit printing pixel is performed using, e.g., Even nozzle 2. After the first pass printing ends, the sheet is supplied by 15/600 inches.

The second pass printing is done using an arbitrary Odd nozzle while the carriage moves in a direction opposite to the main scanning (X) direction. A main droplet and satellite land at distant positions (distant positions in a direction opposite to those of the first pass printing). After the second pass printing ends, the sheet is supplied by 15/600 inches. In FIG. 13A, the second pass printing of the same unit printing pixel is performed using, e.g., Odd nozzle 17. After the second pass printing ends, the sheet is supplied by 15/600 inches.

The third pass printing is done using an arbitrary Odd nozzle while the carriage moves in the X direction. A main droplet and satellite land at close positions. After the third pass printing ends, the sheet is supplied by 16/600 inches. In FIG. 13A, the third pass printing of the same unit printing pixel is performed using, e.g., Odd nozzle 33. After the third pass printing ends, the sheet is supplied by 16/600 inches.

The fourth pass printing is done using an arbitrary Odd nozzle while the carriage moves in a direction opposite to the main scanning (X) direction. A main droplet and satellite land at distant positions. After the fourth pass printing ends, the sheet is supplied by 16/600 inches. In FIG. 13A, the fourth pass printing of the same unit printing pixel is performed using, e.g., Odd nozzle 49. After the fourth pass printing ends, the sheet is supplied by 16/600 inches.

This 4-pass image printing uniformly prints satellites each on the right and left of a pixel printed by main droplets, as shown in FIG. 12A.

The pattern in FIG. 12B will be described.

Figure 13B:
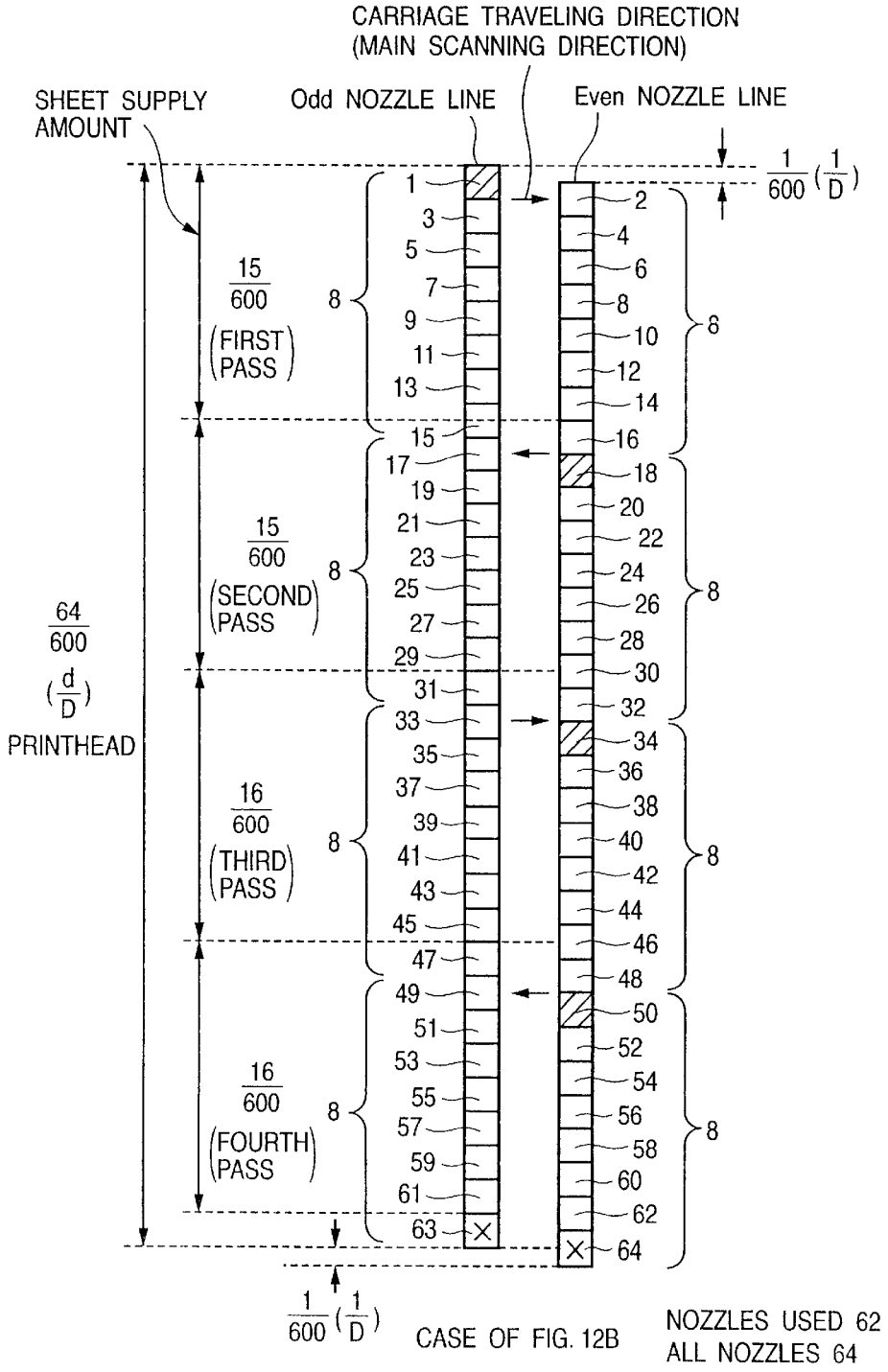
FIG. 13B is a schematic view for explaining a printing method using 4-pass printing according to the second embodiment of the present invention.

In FIG. 12B, the first pass printing is done using an arbitrary Odd nozzle while the carriage moves in the X direction. A main droplet and satellite land at close positions. After the first pass printing ends, a sheet is supplied by 15/600 inches. In FIG. 13B, the first pass printing of a unit printing pixel is performed using, e.g., Odd nozzle 1. After the first pass printing ends, the sheet is supplied by 15/600 inches.

The second pass printing is done using an arbitrary Even nozzle while the carriage moves in a direction opposite to the main scanning (X) direction. A main droplet and satellite land at close positions. After the second pass printing ends, the sheet is supplied by 15/600 inches. In FIG. 13B, the second pass printing of the same unit printing pixel is performed using, e.g., Even nozzle 18. After the second pass printing ends, the sheet is supplied by 15/600 inches.

The third pass printing is done using an arbitrary Even nozzle while the carriage moves in the X direction. A main droplet and satellite land at distant positions. After the third pass printing ends, the sheet is supplied by 16/600 inches. In FIG. 13B, the third pass printing of the same unit printing pixel is performed using, e.g., Even nozzle 34. After the third pass printing ends, the sheet is supplied by 16/600 inches.

The fourth pass printing is done using an arbitrary Even nozzle while the carriage moves in a direction opposite to the main scanning (X) direction. A main droplet and satellite land at close positions. After the fourth pass printing ends, the sheet is supplied by 16/600 inches. In FIG. 13B, the fourth pass printing of the same unit printing pixel is performed using, e.g., Even nozzle 50. After the fourth pass printing ends, the sheet is supplied by 16/600 inches.

This 4-pass image printing prints one satellite on the right of a pixel printed by main droplets, as shown in FIG. 12B.

The patterns in FIGS. 12C and 12D are the same as those in FIGS. 12A and 12B except that carriage traveling directions in respective pass operations are opposite. In FIG. 12C, one satellite is printed on the left of a pixel printed by main droplets. In FIG. 12D, satellites each are uniformly printed on the right and left of a pixel printed by main droplets. A detailed description of them will be omitted.

According to the second embodiment, the dot patterns in FIGS. 12A and 12B alternately appear every 1/D inch in the sheet supply direction. More specifically, pixels (pixels as shown in FIG. 12A) in which satellites appear on the right and left of main droplets, and pixels (pixels as shown in FIG. 12B) in which satellites appear on only the right of main droplets alternately appear every 1/D inch in the sheet supply direction. The dot patterns in FIGS. 12C and 12D alternately appear every 1/D inch in the sheet supply direction. More specifically, pixels (pixels as shown in FIG. 12C) in which satellites appear on only the left of main droplets, and pixels (pixels as shown in FIG. 12D) in which satellites appear on the right and left of main droplets alternately appear every 1/D inch in the sheet supply direction. Hence, image printing in the second embodiment cannot cause satellites to uniformly appear on the right and left of main droplets in all the pixels, unlike image printing in the first embodiment.

However, the second embodiment shown in FIGS. 12A to 12D can solve the conventional problem shown in FIGS. 4A to 4D that all the unit printing pixels are printed by either Even or Odd nozzles for a sheet supply amount corresponding to an even multiple of 1/600 inch. In the second embodiment, pixels in which satellites appear on the right and left of main droplets and pixels in which satellites appear on either the right or left of main droplets alternately appear. This arrangement can reduce the deviation of satellites, compared to an arrangement as shown in FIGS. 4A to 4D in which pixels where satellites appear on the right of main droplets and pixels where satellites appear on the left of main droplets alternately appear.

In the second embodiment, satellites appear in all the pixels including pixels in which satellites appear on the right and left of main droplets. This embodiment can reduce image degradation caused by satellites in comparison with an arrangement as shown in FIGS. 5A to 5D in which pixels where satellites appear on the right and left of main droplets and pixels where no satellite appears alternately appear.

As described above, a printing medium is supplied repetitively by odd, odd, even, and even multiples of 1/600 inch in 4-pass printing. In this case, dots discharged from Even and Odd nozzles can be mixedly printed in all the unit printing pixels. To minimize image degradation caused by satellites, pixels in which satellites appear on the right and left of main droplets and pixels in which satellites appear on either the right or left of main droplets alternately appear every 1/D inch in the sheet supply direction. Compared to the conventional arrangements in FIGS. 4A to 4D and 5A to 5D, the image uniformity is improved as a whole. As a result, the second embodiment can provide an ink-jet printer capable of printing a high-quality image while avoiding printing of a nonuniform image.

Note that 4-pass printing has been exemplified, but the above description can be applied to multipass printing of two or more passes. In the above description, the Even and Odd nozzles of each ink printhead are aligned on different nozzle lines. The printhead may take another array in which, e.g., Even and Odd nozzles are aligned on the same line.

If the nozzle line of the printhead is made up of nozzles aligned at a density of D nozzles per inch (D dpi) and a nozzle pitch P (P=1/D), the resolution of one pulse of the motor which drives the sheet supply roller for conveying a printing medium is D dots per inch (D dpi) or a multiple of D dpi in covey amount conversion.

Third Embodiment

An ink-jet printer according to the third embodiment will be described.

The mechanical arrangement, control arrangement, and printhead of the ink-jet printer according to the third embodiment are the same as the mechanical arrangement (FIG. 1), control arrangement (FIG. 6), and printhead (FIGS. 7 and 8) of the ink-jet printer described in the first embodiment, and a repetitive description thereof will be omitted.

[Multipass Printing Mode]

A multipass printing mode using the ink-jet printer and printhead will be explained.

In the following description, a 4-pass printing mode in which a color nozzle line is divided into four by m=4 and an image is completed by four scanning operations will be exemplified as a multipass printing mode in which a color nozzle line is divided into m (m is 2 or more) and an image is completed by m scanning operations.

The feature of the third embodiment will be described.

In the first and second embodiments, the volumes of ink droplets from Even and Odd nozzles are the same. In the third embodiment, the volume of an ink droplet discharged from an Even nozzle is large (large dot), and that from an Odd nozzle is small (small dot).

The number of nozzles of the printhead, nozzle length, and nozzle pitch in the third embodiment are the same as those of the printhead described in the first embodiment. The third embodiment is different from the first embodiment in that the volume of an ink droplet discharged from an Even nozzle is large and that from an Odd nozzle is small. The printhead in the third embodiment is identical to the printhead (FIGS. 8, 10A, and 10B) in the first embodiment, and the following description adopts the same drawings (FIGS. 8, 10A, and 10B).

In the third embodiment, the present invention is applied to a case in which four sheet supply amounts of a printing medium are alternately set to even and odd multiples of 1/D inch in a 4-pass printing mode, similar to the first embodiment.

An image printing method according to the third embodiment in the color 4-pass printing mode will be explained with reference to FIGS. 14A to 14D.

FIGS. 14A to 14D are schematic views each showing a dot pattern when a 1/600-inch region is defined as a unit printing pixel in the multipass printing mode for performing 4-pass printing, two large dots and two small dots are printed in the unit printing.pixel, and a sheet is supplied repetitively by even and odd multiples of 1/600 inch.

Figure 14A:
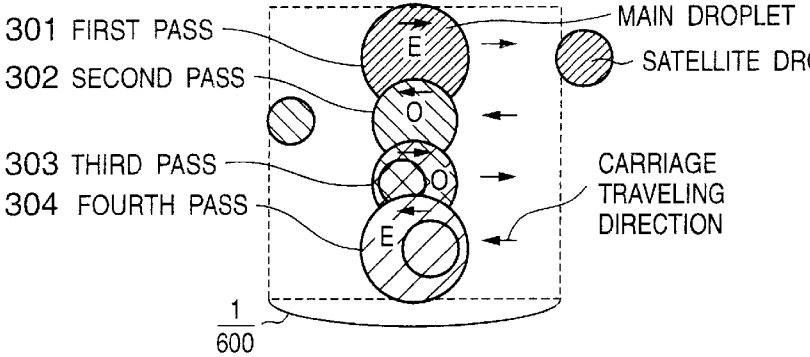
FIGS. 14A to 14D are schematic views showing four dot patterns formed when the ink droplet discharge direction of the Even nozzle inclines to the main scanning direction in 4-pass printing according to the third embodiment of the present invention, and that of the Odd nozzle inclines to a direction opposite to the main scanning direction.

FIG. 14A is a schematic view showing a dot pattern when the first pass printing starts by an Even nozzle while the carriage travels in the main scanning (X) direction.

Figure 14B:
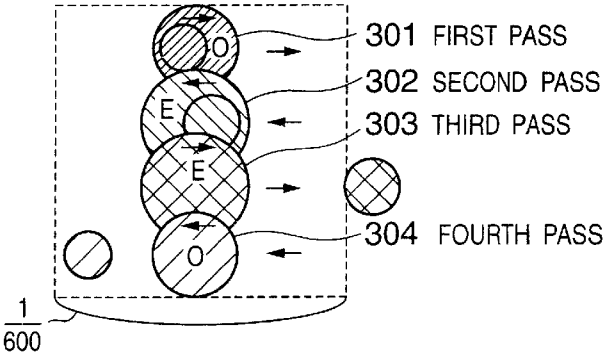

FIG. 14B is a schematic view showing a dot pattern when the first pass printing starts by an Odd nozzle while the carriage travels in the main scanning (X) direction.

Figure 14C:
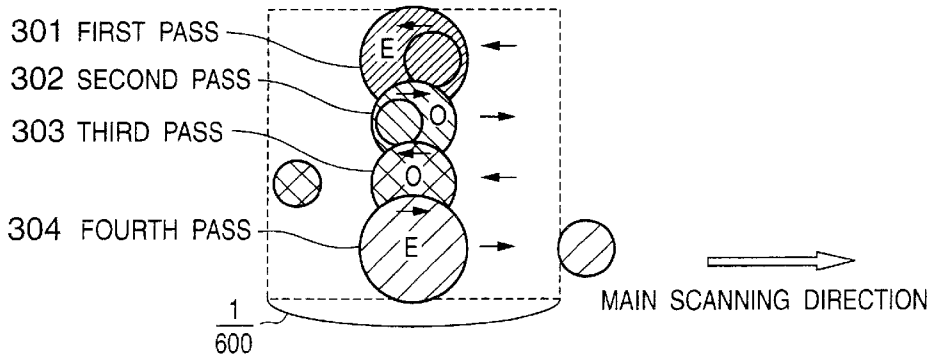

FIG. 14C is a schematic view showing a dot pattern when the first pass printing starts by an Even nozzle while the carriage travels in a direction opposite to the main scanning (X) direction.

Figure 14D:
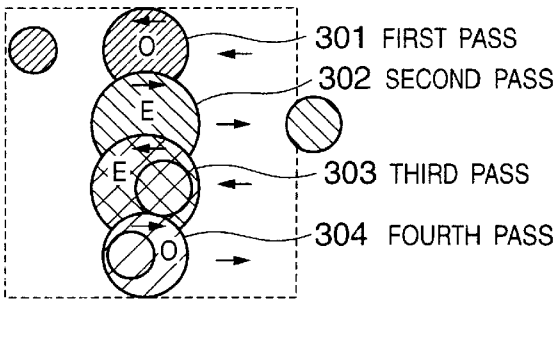

FIG. 14D is a schematic view showing a dot pattern when the first pass printing starts by an Odd nozzle while the carriage travels in a direction opposite to the main scanning (X) direction.

In FIGS. 14A to 14D, reference numeral 301 denotes a first pass printing dot; 302, a second pass printing dot; 303, a third pass printing dot; and 304, a fourth pass printing dot. In practice, four, first to fourth pass printing dots overlap each other and are printed. In FIGS. 14A to 14D, one main droplet and two satellites are formed, which express the tonality of the unit printing pixel. The following description adopts the above expression for descriptive convenience.

The dot patterns in FIGS. 14A to 14D appear on a printing medium as follows. That is, the dot patterns in FIGS. 14A and 14B (or FIGS. 14C and 14D) alternately appear every 1/D inch in the sheet supply direction.

In FIGS. 14A to 14D, arrows (← and→) illustrated in the unit printing pixel represent carriage traveling directions in respective pass printing operations. E represents a dot printed by an Even nozzle, and O represents a dot printed by an Odd nozzle.

The ink droplet discharge direction inclines to the main scanning (X) direction for an Even nozzle and an opposite direction for an Odd nozzle.

Image printing in the multipass printing mode (four passes) will be described in detail with reference to FIGS. 14A to 14D, 10A, and 10B.

The pattern in FIG. 14A will be described.

In FIG. 14A, a large dot is printed by the first pass printing using an arbitrary Even nozzle while the carriage moves in the X direction. A main droplet and satellite land at distant positions. After the first pass printing ends, a sheet is supplied by 16/600 inches. In FIG. 10A, the first pass printing of a unit printing pixel is performed using, e.g., Even nozzle 2. After the first pass printing ends, the sheet is supplied by 16/600 inches.

A small dot is printed by the second pass printing using an arbitrary Odd nozzle while the carriage moves in a direction opposite to the main scanning (X) direction. A main droplet and satellite land at distant positions (distant positions in a direction opposite to those of the first pass printing). After the second pass printing ends, the sheet is supplied by 15/600 inches. In FIG. 10A, the second pass printing of the same unit printing pixel is performed using, e.g., Odd nozzle 17. After the second pass printing ends, the sheet is supplied by 15/600 inches.

A small dot is printed by the third pass printing using an arbitrary Odd nozzle while the carriage moves in the X direction. A main droplet and satellite land at close positions. After the third pass printing ends, the sheet is supplied by 16/600 inches. In FIG. 10A, the third pass printing of the same unit printing pixel is performed using, e.g., Odd nozzle 33. After the third pass printing ends, the sheet is supplied by 16/600 inches.

A large dot is printed by the fourth pass printing using an arbitrary Even nozzle while the carriage moves in a direction opposite to the main scanning (X) direction. A main droplet and satellite land at close positions. After the fourth pass printing ends, the sheet is supplied by 15/600 inches. In FIG. 10A, the fourth pass printing of the same unit printing pixel is performed using, e.g., Even nozzle 50. After the fourth pass printing ends, the sheet is supplied by 15/600 inches.

This 4-pass image printing uniformly prints satellites each on the right and left of a pixel printed by main droplets, as shown in FIG. 14A.

The pattern in FIG. 14B will be described.

In FIG. 14B, a small dot is printed by the first pass printing using an arbitrary Odd nozzle while the carriage moves in the X direction. A main droplet and satellite land at close positions. After the first pass printing ends, a sheet is supplied by 16/600 inches. In FIG. 10B, the first pass printing of a unit printing pixel is performed using, e.g., Odd nozzle 1. After the first pass printing ends, the sheet is supplied by 16/600 inches.

A large dot is printed by the second pass printing using an arbitrary Even nozzle while the carriage moves in a direction opposite to the main scanning (X) direction. A main droplet and satellite land at close positions. After the second pass printing ends, the sheet is supplied by 15/600 inches. In FIG. 10B, the second pass printing of the same unit printing pixel is performed using, e.g., Even nozzle 18. After the second pass printing ends, the sheet is supplied by 15/600 inches.

A large dot is printed by the third pass printing using an arbitrary Even nozzle while the carriage moves in the X direction. A main droplet and satellite land at distant positions. After the third pass printing ends, the sheet is supplied by 16/600 inches. In FIG. 10B, the third pass printing of the same unit printing pixel is performed using, e.g., Even nozzle 34. After the third pass printing ends, the sheet is supplied by 16/600 inches.

A small dot is printed by the fourth pass printing using an arbitrary Odd nozzle while the carriage moves in a direction opposite to the main scanning (X) direction. A main droplet and satellite land at distant positions (distant positions in a direction opposite to those of the third pass printing). After the fourth pass printing ends, the sheet is supplied by 15/600 inches. In FIG. 10B, the fourth pass printing of the same unit printing pixel is performed using, e.g., Odd nozzle 49. After the fourth pass printing ends, the sheet is supplied by 15/600 inches.

This 4-pass image printing uniformly prints satellites each on the right and left of a pixel printed by main droplets, as shown in FIG. 14B.

The patterns in FIGS. 14C and 14D are the same as those in FIGS. 14A and 14B except that carriage traveling directions in respective pass operations are opposite. As shown in FIG. 14C or 14D, satellites are uniformly printed on the right and left of a pixel printed by main droplets, and a detailed description thereof will be omitted.

More specifically, when a 600-inch unit printing pixel is printed by multipass printing (4-dot printing), satellites discharged from Even and Odd nozzles are printed each on the right and left of a pixel printed by main droplets in any case, as shown in FIGS. 14A to 14D.

Note that 4-pass printing has been exemplified, but the above description can be applied to multipass printing of two passes or more. In the above description, the Even and Odd nozzles of each ink printhead are aligned on different nozzle lines. The printhead may take another array in which, e.g., Even and Odd nozzles are aligned on the same line.

As described above, the ink-jet printer of the third embodiment supplies a printing medium repetitively by even and odd multiples of 1/D (1/600 inch in the above description) in multipass printing of two passes or more (four passes in the above description). In-this case, large and small dots discharged from Even and Odd nozzles are uniformly printed in all the unit printing pixels, and satellites are uniformly printed (distributed) on the right and left of main droplets. Printing of a nonuniform image can be avoided, and high-quality image printing can be realized.

As sheet conveyance executed between passes, the first to third embodiments have described example 1) in which sheet conveyance at an odd multiple of the nozzle pitch and sheet conveyance at an even multiple thereof are sequentially repeated, and example 2) in which sheet conveyance at an odd multiple of the nozzle pitch, sheet conveyance at an odd multiple thereof, sheet conveyance at an even multiple thereof, and sheet conveyance at an even multiple thereof are sequentially repeated. The present invention is not limited to these sheet conveyance methods. The present invention suffices to execute sheet conveyance such that sheet conveyance at an odd multiple of the nozzle pitch and sheet conveyance at an even multiple thereof are included at least once in sheet conveyance executed between scanning operations in multipass printing of completing printing of a predetermined region by scanning a printhead a plurality of number of times.

In the above embodiments, droplets discharged from the printhead are ink droplets, and a liquid stored in the ink tank is ink. However the liquid to be stored in the ink tank is not limited to ink. For example, a treatment solution to be discharged onto a printing medium so as to improve the fixing property or water resistance of a printed image or its image quality may be stored in the ink tank.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention.

In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention.

In this case, as described in Japanese Patent Laid Open No. 54-56847 or Japanese Patent Laid Open No. 60-71260, an ink may be supplied in a form of perforated sheet opposed to the electrothermal transducer in which the ink is maintained in liquid or solid within a dent or a through-hole thereon. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program code for performing the aforesaid processes to a computer system or apparatus (e.g., a personal computer), reading the program code, by a CPU or MPU of the computer system or apparatus, from the storage medium, then executing the program. In this case, the program code read from the storage medium realize the functions according to the embodiments, and the storage medium storing the program code constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program code. Furthermore, additional functions according to the above embodiments are realized by executing the program code which are read by a computer. The present invention includes a case where an OS (operating system) or the like working on the computer performs a part or entire process in accordance with designations of the program code and realizes functions according to the above embodiments. Furthermore, the present invention also includes a case where, after the program code read from the storage medium are written in a function expansion card which is inserted into the computer or in a memory provided in a function expansion unit which is connected to the computer, a CPU or the like contained in the function expansion card or function expansion unit performs a part or entire process in accordance with designations of the program code and realizes functions of the above embodiments.

When the present invention is applied to the storage medium, the storage medium stores program codes corresponding to FIGS. 10A, 10B, 13A, and 13B described above.

As has been described above, the present invention can provide an image printing apparatus capable of printing a uniform, high-quality image while avoiding printing of a visually nonuniform image in multipass printing of two or more passes, and a control method therefor.

As many apparently widely different embodiments of the present invention can be made without departing from the spirit and scope thereof, it is to be understood that the invention is not limited to the specific embodiments thereof except as defined in the claims.

What is claimed is:

1. A printing apparatus which prints onto a predetermined printing region of a printing medium by using a printhead having a plurality of nozzles that are aligned at a predetermined nozzle pitch and discharge ink droplets, and scanning the printhead a plurality of times, with respect to the predetermined printing region, in a direction cross to an alignment direction of the nozzles and discharging ink droplets from different nozzles of the printhead onto the predetermined printing region in the plurality of scanning operations, comprising:

convey means for conveying the printing medium in a convey direction by a predetermined convey amount of every scanning; and control means for controlling the convey amount of every scanning to a convey amount corresponding to either one of even and odd multiples of the nozzle pitch, and setting the convey amount corresponding to each of the even and odd multiples of the nozzle pitch at least once in the plurality of scanning operations for printing onto the predetermined printing region.

2. The apparatus according to claim 1, wherein the convey amounts in the plurality of scanning operations appear in a specific cycle.

3. The apparatus according to claim 2, wherein the specific cycle includes an equal numbers of the convey amounts corresponding to even and odd multiples of the nozzle pitch.

4. The apparatus according to claim 2, wherein the convey amounts corresponding to even and odd multiples of the nozzle pitch alternately appear in the specific cycle.

5. The apparatus according to claim 1, wherein the printhead has a plurality of nozzle lines.

6. The apparatus according to claim 1, wherein the printhead has a plurality of nozzle lines, and at least two lines discharge ink of the same color.

7. The apparatus according to claim 1, wherein the printhead has a plurality of nozzle lines, and at least two lines have different discharge characteristics.

8. The apparatus according to claim 7, wherein the discharge characteristics relate to ink discharge amounts.

9. The apparatus according to claim 7, wherein the discharge characteristics relate to ink discharge directions.

10. The apparatus according to claim 1, wherein the predetermined printing region is one pixel region.

11. The apparatus according to claim 1, wherein the plurality of scanning operations for printing onto the predetermined printing region include scanning operations in a first direction and a second direction opposite to the first direction.

12. The apparatus according to claim 11, wherein the scanning operations in the first and second directions are performed alternately.

13. The apparatus according to claim 1, wherein the plurality of scanning operations for printing onto the predetermined printing region include scanning operations in a first direction and a second direction opposite to the first direction, wherein a plurality of ink droplets discharged onto the predetermined printing region overlap each other in the plurality of scanning operations in the first and second directions performed alternately, and a direction of the ink droplet discharged from a first nozzle line having odd numbered nozzles in the plurality of nozzles aligned at the predetermined nozzle pitch is different in scanning direction from a direction of the ink droplet discharged from a second nozzle line having even number nozzles in the plurality of nozzles.

14. A control method for a printing apparatus which prints onto a predetermined region of a printing medium by using a printhead having a plurality of nozzles that are aligned at a predetermined nozzle pitch and discharge ink droplets, and scanning the printhead a plurality of times, with respect to the predetermined printing region, in a direction cross to an alignment direction of the nozzles and discharging ink droplets from different nozzles of the printhead onto the predetermined printing region in the plurality of scanning operations, comprising:

a convey step, of conveying the printing medium in a convey direction by a predetermined convey amount of every scanning; and a control step, of controlling the convey amount of every scanning to a convey amount corresponding to either one of even and odd multiples of the nozzle pitch, and setting the convey amount corresponding to each of the even and odd multiples of the nozzle pitch at least once in the plurality of scanning operations for printing onto the predetermined printing region.

15. A computer-readable storage medium which stores a control program for a printing apparatus which prints onto a predetermined printing region of a printing medium by using a printhead having a plurality of nozzles that are aligned at a predetermined nozzle pitch and discharge ink droplets, and scanning the printhead a plurality of times, with respect to the predetermined printing region, in a direction cross to an alignment direction of the nozzles and discharging ink droplets from different nozzles of the printhead onto the predetermined printing region in the plurality of scanning operations, the control program comprising:

a program code of a convey step, of conveying the printing medium in a convey direction by a predetermined convey amount of every scanning; and a program code of a control step, of controlling the convey amount of every scanning to a convey amount corresponding to either one of even and odd multiples of the nozzle pitch, and setting the convey amount corresponding to each of the even and odd multiples of the nozzle pitch at least once in the plurality of scanning operations for printing onto the predetermined printing region.

16. A control program for a printing apparatus which prints onto a predetermined printing region of a printing medium by using a printhead having a plurality of nozzles that are aligned at a predetermined nozzle pitch and discharge ink droplets, and scanning the printhead a plurality of times, with respect to the predetermined printing region, in a direction cross to an alignment direction of the nozzles and discharging ink droplets from different nozzles of the printhead onto the predetermined printing region in the plurality of scanning operations, comprising:

a program code of a convey step of conveying the printing medium in a convey direction by a predetermined convey amount of every scanning; and a program code of a control step of controlling the convey amount of every scanning to the convey amount corresponding to either one of even and odd multiples of the nozzle pitch, and setting the convey amount corresponding to each of the even and odd multiples of the nozzle pitch at least once in the plurality of scanning operations for printing onto the predetermined printing region.

17. A printing apparatus which prints onto a predetermined printing region of a printing medium by using a printhead having a plurality of nozzles that are aligned at a predetermined nozzle pitch and discharge same-color ink droplets, and scanning the printhead a plurality of times, with respect to the predetermined printing region, in a first direction and a second direction opposite to the first direction cross to an alignment direction of the nozzles, and discharge ink droplets from different nozzles of the printhead onto the predetermined printing region in the plurality of scanning operations including scanning operations in the first direction and the second direction, comprising:

convey means for conveying the printing medium in a convey direction by a predetermined convey amount of every scanning; and control means for controlling a convey amount of the every scanning to a convey amount corresponding to either one of even and odd multiples of the nozzle pitch, and setting the convey amount corresponding to each of the even and odd multiples of the nozzle pitch at least once in the plurality of scanning operations for printing onto the predetermined printing region, wherein a direction of the ink droplet discharged from nozzles belonging to a first nozzle line in the plurality of nozzles aligned at the predetermined nozzle pitch is different from a direction of ink droplet discharged from nozzles belonging to a second nozzle line in the plurality of nozzles aligned at the predetermined nozzle pitch.

18. The apparatus according to claim 17, wherein the direction of the ink droplet discharged from the nozzles in the first nozzle line is different in scanning direction from the direction of the ink droplet discharged from the nozzles in the second nozzle line.

19. The apparatus according to claim 18, wherein the direction of the ink droplet discharged from nozzles in the first nozzle line inclines in the first direction to a vertical direction perpendicular to the scanning direction and the convey direction and the direction of the ink droplet discharged from the nozzles in the second nozzle line inclines in the second direction to the vertical direction.

20. The apparatus according to claim 17, wherein the nozzles in the first nozzle line are odd numbered nozzles in the plurality of nozzles and nozzles in the second nozzle line are even numbered nozzles in the plurality of nozzles.

21. The apparatus according to claim 20, wherein a relation in scanning direction between landing positions of a main droplet and a satellite droplet discharged from nozzles in the first nozzle line is different from a relation in the scanning direction between the landing positions of the main droplet and the satellite droplet discharged from the nozzles in the second nozzle line.

22. The apparatus according to claim 21, wherein the predetermined printing region is a unit printing pixel region, a width in the convey direction of the unit printing pixel region is the same as the width corresponding to the predetermined nozzle pitch, and a plurality of ink droplets discharged on the unit printing pixel region from different nozzles overlap each other.

23. A printing apparatus which prints onto a unit printing pixel region of a printing medium by using a printhead having a plurality of nozzles that are aligned at a predetermined nozzle pitch and discharge same-color ink droplets, and scanning the printhead a plurality of times, with respect to the unit printing pixel region, in a direction cross to an alignment direction of the nozzles, and discharge ink droplets from different nozzles of the printhead onto the unit printing pixel region, comprising:

printing means for printing onto the unit printing pixel region by discharging the same color ink droplets from the printhead in the plurality of scanning operations which include scanning operations in a first direction and a second direction opposite to the first direction being performed alternately;

convey means for conveying the printing medium in a convey direction by a predetermined convey amount of every scanning; and control means for controlling the convey amount of the every scanning to a convey amount corresponding to either one of even and odd multiples of the nozzle pitch, and setting the convey amount corresponding to each of the even and odd multiples of the nozzle pitch at least once in the plurality of scanning operations for printing onto the unit printing pixel region, wherein a direction of the ink droplet discharged from a first nozzle line having odd number nozzles in the plurality of nozzles aligned at the predetermined nozzle pitch is different from a direction of the ink droplet discharged from a second nozzle line having even number nozzles in the plurality of nozzles.

24. A printing apparatus which prints onto a unit printing pixel region of a printing medium by using a printhead having a plurality of nozzles that are aligned at a predetermined nozzle pitch and discharge same-color ink droplets, and scanning the printhead a plurality of times, with respect to the unit printing pixel region, in a direction cross to an alignment direction of the nozzles, and discharge ink droplets from different nozzles of the printhead onto the unit printing pixel region, comprising:

printing means for printing onto the unit printing pixel region by discharging the same-color ink droplets from the printhead in the plurality of scanning operations which include scanning operations in a first direction and a second direction opposite to the first direction being performed alternately;

convey means for conveying the printing medium in a convey direction by a predetermined convey amount of every scanning; and control means for controlling the convey amount of the every scanning to a convey amount corresponding to either one of even and odd multiples of the nozzle pitch, and setting the convey amount corresponding to each of the even and odd multiples of the nozzle pitch at least once in the plurality of scanning operations for printing onto the unit printing pixel region, wherein a relation in the scanning direction between landing positions of a main droplet and a satellite droplet discharged from a first nozzle line having odd number nozzles in the plurality of nozzles aligned at the predetermined nozzle pitch is different from a relation in the scanning direction between the landing positions of the main droplet and the satellite droplet discharged from a second nozzle line having even number nozzles in the plurality of nozzles.

* * * * *

UNITED STATES PATENT AND TRADEMARK OFFICE

CERTIFICATE OF CORRECTION

PATENT NO. : 6,682,168 B2
DATED : January 27, 2004
INVENTOR(S) : Yoshinori Nakagawa et al.

It is certified that error appears in the above-identified patent and that said Letters Patent is hereby corrected as shown below:

Column 2,
Line 16, “a;” should read -- a --.

Column 5,
Line 9, “direction” should read -- direction (X) --.

Column 6,
Line 16, “inclinaptions” should read -- inclination --; and
Line 60, “SD” should read -- 5D --.

Column 18,
Line 38, “printing.” should read -- printing --.

Column 20,
Line 40, “-this” should read -- this --.

Column 23,
Line 51, “numbers” should read -- number --.

Signed and Sealed this

Twentieth Day of July, 2004

JON W. DUDAS
*Acting Director of the United States Patent and Trademark Office*